US005596395A

United States Patent [19]

Sawamura et al.

[11] Patent Number: 5,596,395

[45] Date of Patent: Jan. 21, 1997

[54] IMAGE FORMING APPARATUS AND ITS CONTROL SYSTEM HAVING A SINGLE DEVICE FOR MOVING A CHARGING MEMBER AND A TRANSFER MEMBER

[75] Inventors: Tadahide Sawamura, Machida; Takaaki Tawada, Yokohama; Fumihito Itoh, Kawasaki, all of Japan

[73] Assignee: Ricoh Company, Ltd., Tokyo, Japan

[21] Appl. No.: 531,650

[22] Filed: Sep. 21, 1995

[30] Foreign Application Priority Data

Sep. 21, 1994 [JP] Japan ..... 6-227004

[51] Int. Cl.[6] ..... G03G 15/02

[52] U.S. Cl. ..... 399/168; 361/221; 399/297

[58] Field of Search ..... 355/219, 271, 355/274; 361/220, 221, 225, 230

[56] References Cited

U.S. PATENT DOCUMENTS 5,051,783 9/1991 Sato ..... 355/271
5,227,851 7/1993 Yoshida et al. ..... 355/271
5,415,966 5/1995 Matsuura ..... 355/274 X
5,420,676 5/1995 Arcaro ..... 355/271

*Primary Examiner*—William J. Royer
*Attorney, Agent, or Firm*—Oblon, Spivak, McClelland, Maier & Neustadt, P.C.

[57] ABSTRACT

An image forming apparatus having a single driving source to move a charging roller and a transfer roller to be in contact with and separated from a photoreceptor to place the charging member and the transfer member in various states in relation to the photoreceptor as the image forming apparatus demands. The single driving source includes first and second cams having a common axis of rotation. One cam is used to move the charging member and the other cam is used to drive the transfer member. The control system is provided with a device for recognizing the current positions of the charging member and the transfer member in relation to the photoreceptor and a device for prescribing future positions of the charging member and the transfer member in relation to the photoreceptor after having been driven. The apparatus further includes a controller which operates the driving source until the charging member and the transfer member come to a state prescribed as the state to reach after from the current position.

9 Claims, 17 Drawing Sheets

IMAGE FORMING APPARATUS AND ITS CONTROL SYSTEM HAVING A SINGLE DEVICE FOR MOVING A CHARGING MEMBER AND A TRANSFER MEMBER

BACKGROUND OF THE INVENTION

1. Field of the Invention

The invention relates to an image forming apparatus such as a copying machine wherein a charging member and a transfer member are movable individually using a single driving device in both directions of contacting with and separating from a photoreceptor, and more particularly to a driving apparatus and its control system for enabling such movement of the charging member and the transfer member.

2. Discussion of the Background

In an image forming apparatus wherein an electrophotographic method is employed such as a copying machine, a method of charging a photoreceptor with an electrostatic charge called a contact charging method has become popular in recent years. It is a method of charging a photoreceptor uniformly by bringing a charging member, such as a charging roller or a charging blade into contact with the photoreceptor. It has an advantage over a conventional charging method by corotron in that it prevents emission of ozone which is harmful to the human body, and also an advantage of being capable of charging using a relatively low voltage.

However, there exists a problem with this method in that materials contained in the charging member such as a plastic material which has a bad influence upon the photoreceptor are oozed out causing a deterioration of the photoreceptor and an ununiformity of the electrostatic charge. This problem has been observed also in the transfer member such as a transfer belt or a transfer roller which is brought into contact with the photoreceptor.

In order to avoid such a problem, there have been proposed various methods of separating the charging member and the transfer member from the photoreceptor when the apparatus is not in operation and bringing such members into contact with the photoreceptor when the apparatus is in the operation of forming an image. FIG. 20 and FIG. 21 are schematic drawings showing an example of such a mechanism of driving the charging member and the transfer member in an image forming apparatus. In the driving mechanism shown in FIG. 20 and FIG. 21, the first solenoid 53 and the second solenoid 54 are employed respectively as a driving source for moving a charging member 51 and a transfer member 52 in both directions of contacting with and separating from a photoreceptor 50. As shown in FIG. 20, the charging member 51 is mounted on a link 56 which is rotatable around a fulcrum 55 and is normally separated from the photoreceptor 50 by the pulling power of a pulling spring 57. To the base end of the link 56 is connected the first solenoid 53 and the link 56 is rotated clockwise by the action of the first solenoid 53 to bring, coupled with the pressuring power of a pressuring spring 58, the charging member 51 into contact with the photoreceptor 50. The transfer member 52 is mounted on a link 60 which is rotatable around a fulcrum 59. At the middle part of the link 60 is contacted a link 62 which is rotatable around a fulcrum 61. Further, the second solenoid 54 is connected to the base end of the link 62 and a pulling spring 63 is connected at the top end. When the second solenoid 54 is off, the link 62 rotates clockwise by the pulling spring 63, lowering the link 60 downwardly to separate the charging member 52 from the photoreceptor 50 as shown in FIG. 20. When the second solenoid 54 is on, the link 62 rotates counter-clockwise, thereby rotating the link 60 counter-clockwise by the pressuring power from the pressuring spring 64 to bring the transfer member 52 into contact with the photoreceptor 50 as shown in FIG. 21.

As described above, movement of the charging member 51 and the transfer member 52 to the directions of contacting with and separating from the photoreceptor 50 are controlled by individual driving sources in the mechanism shown in FIG. 20 and FIG. 21. Therefore, there exists in such mechanism problems such as the mechanism becoming complicated, the size of the apparatus becoming large and the cost of the parts becoming high. Further, the control of driving such mechanism becomes complicated due to the necessities of controlling individual driving sources.

FIG. 22 and FIG. 23 are schematic drawings showing another example of driving a charging member and a transfer member, which has been proposed to overcome the above problems. In the mechanism shown in these drawings, a solenoid 70 is connected to the base end of the link 56 on which the charging member 51 is mounted and to the base end of the link 62 which gives movement to the transfer member 52 to contact with and separate from the photoreceptor 50. When the solenoid 70 is off, the charging member 51 is separated from the photoreceptor 50 by the pulling power from the pulling spring 57, and the transfer member 52 is separated from the photoreceptor 50 resisting to the pressuring power from the pressuring spring 64. When the solenoid 70 is on, the link 56 rotates clockwise, resisting the pulling power of the pulling spring 57, to bring the charging member 51 into contact with the photoreceptor 50, coupled with the pressuring power from the pressuring spring 58, and at the same time, the link 60, support for the same by the link 62 having been released, rotates counter-clockwise to bring the transfer member 52 into contact with the photoreceptor 50, coupled with the pressuring power from the pressuring spring 64.

Now, in an image forming apparatus such as copying machines, the density of the images being produced are inspected periodically by a photosensor such as a photosensor 71 illustrated in FIG. 23 for the purpose of maintaining the image density at a certain level every time a prescribed number of the image forming operations has been made. Namely, a standard image, hereinafter referred to as a pattern image is generated automatically on the photoreceptor (in a way well known in the industry) after a prescribed number of the image forming operations have been performed, and the image density of such a pattern image, after its development, is inspected by the photosensor provided in the apparatus. Various parameters of the apparatus are adjusted in accordance with the detected image so that the apparatus continues to produce images of the same density. In a conventional apparatus, the photosensor is placed between a developing unit and a transfer member, and it is normally designed so that the inspection by the photosensor is carried out before the pattern image, after being developed, reaches the point where the pattern image comes in contact with the transfer member.

However, as image forming apparatuses become more versatile in functions, such a design as to place the photosensor on the downstream of the transfer member has been employed in some apparatus of recent development. In such apparatuses, there occurs a problem in that the pattern image is destroyed by the transfer member before being inspected by the photosensor, if the transfer member is in contact with the photoreceptor when the pattern image reaches the point of contact with the photoreceptor.

According to the driving mechanism shown in FIG. 22 and FIG. 23, the transfer member 52 is in contact with the photoreceptor 50 when the charging member 51 is in contact with the photoreceptor 50, and likewise, the transfer member 52 is separated from the photoreceptor 50 when the charging member 51 is separated from the photoreceptor 50, since the charging member and the transfer member are both driven integrally by the same driving source and only two motions are available. With such a mechanism, in the case the photosensor 71 cannot be placed between the developing unit and the transfer member and has to be placed on the downstream of the transfer member 52, it becomes impossible to inspect the image density periodically for the purpose of maintaining the image density at the same level, since the pattern image 71*p* is destroyed by the transfer member 52 as described above with such a driving mechanism.

SUMMARY OF THE INVENTION

The present invention has been made in view of such problems, and therefore, an object of the present invention is to accomplish with a simple and compact mechanism a single driving mechanism for moving a charging member and a transfer member of an image forming apparatus to either contact with or separate from a photoreceptor so that the charging member and the transfer member can be placed in various states in relation to the photoreceptor as the image forming apparatus demands.

A further object of the present invention is to accomplish with a simple control program, a control of this driving mechanism for realizing such various states of the charging member and the transfer member in relation to the photoreceptor in accordance with the needs of the image forming apparatus.

In order to achieve the above-mentioned objects, a driving apparatus for a charging member and a transfer member of the present invention includes a single driving source which enables individual movement of the charging member and the transfer member so that the charging member and the transfer member can be placed in any state of 1) both the charging member and the transfer member being in contact with a photoreceptor, 2) both the charging member and the transfer member being separated from the photoreceptor, and 3) one of the charging member and the transfer member being in contact with the photoreceptor while the other member is separated from the photoreceptor. For example, such a single driving source can be made of a revolving driving source which integrally rotates a first cam for moving the charging member and a second cam member for moving the transfer member and stops these cams integrally at plural positions, thus achieving various states of the charging member and the transfer member in relation to the photoreceptor, as described above. The single driving source can achieve simplification of the mechanism, reduction of the size of the apparatus and lowering of the cost of the parts of the apparatus.

Further, a control system for the above-mentioned driving apparatus according to the present invention includes a device to recognize the current (present) state of the charging member in relation to the photoreceptor, a device to recognize the current (present) state of the transfer member in relation to the photoreceptor, a device to prescribe the state of the charging member in relation to the photoreceptor after having been driven, and a device to prescribe the state of the transfer member in relation to the photoreceptor after having been driven. A driving source is operated by a controller until the charging member and the transfer member come to a state prescribed individually as the state to reach after having been driven based upon the information as to the current state and the state after having been driven of the charging member and the transfer member.

Further, the control system for the above-mentioned driving apparatus for the charging member and the transfer member according to the present invention includes a cam base state position detector for detecting if the charging member and the transfer member are at a prescribed base state, a device for prescribing automatically the state of the charging member and the transfer member in relation to the photoreceptor when the charging member and the transfer member are not at the base state when the power is made on, and a device for assuming the current state of the charging member and the transfer member is in a predetermined position in relation to the photoreceptor when the positions of the charging member and the transfer member are not at the base state when the power is made on and the position of a cam is not known. There is a controller which operates the driving source for the charging member and the transfer member until these members come to the base state from such state presumed as an accurate position. When the charging member and the transfer member are not detected by the base state detecting position detector as being in the base state after having been driven, the control means continues to operate the driving source of the charging member and the transfer member until the charging member and the transfer member come to the base state.

The device to recognize the current state of the charging member and the device to recognize the current state of the transfer member may be so configured to recognize the current state of these members based upon the operations of the driving source made after the charging member and the transfer member having been put at the base state by the controller.

Moreover, since the driving apparatus for the charging member and the transfer member according to the present invention enables an individual movement of the charging member and the transfer member, it becomes possible to bring these members in any state in relation to the photoreceptor as the image forming apparatus demands. For example, the charging member and the transfer member can be brought to the state where both members are in contact with the photoreceptor while the apparatus is in the image forming operation and to the state where these members are separated from the photoreceptor while the apparatus is not in operation. And further, only the charging member can be brought into contact with the photoreceptor, separating the transfer member from the photoreceptor thereby avoiding the pattern image from being destroyed by the transfer member when the inspection of the image density by the photosensor is to be operated for the purpose of maintaining the image density at the same level. Therefore, even if the image forming apparatus is so designed that the photosensor is placed downstream of the transfer member, it becomes possible to perform such inspection of the image density by the photosensor with the driving apparatus of the present invention.

Also, the control system according to the present invention, recognizing the current state of the charging member and the transfer member in relation to the photoreceptor and further prescribing the state of these members after having been driven, can calculate the movement necessary for these members to be driven to the state as prescribed from the current state and operate the driving source accordingly based upon the result of such calculation.

Also, if the charging member and the transfer member are so configured as to be in a prescribed base state when the power is made on, the state of the charging member and the transfer member in relation to the photoreceptor can be recognized easily and precisely based upon the operations of the driving source after the power is made on.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 11 is a flowchart illustrating a homing operation of the control system when the power is turned on;

DESCRIPTION OF THE PREFERRED EMBODIMENTS

Figure 19:
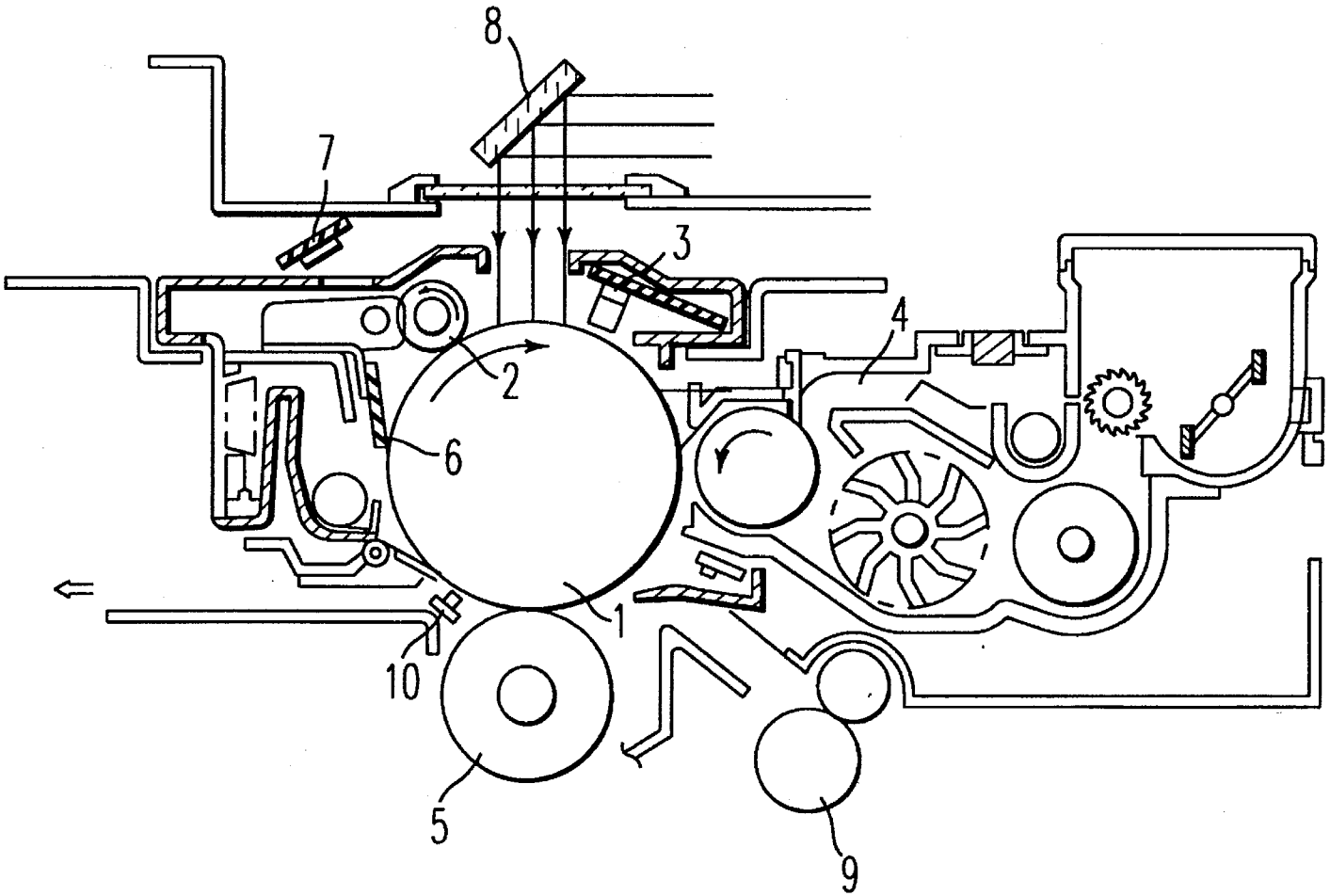
FIG. 19 is a schematic drawing showing a structure of an image forming apparatus in accordance with the present invention.
Figure 20:
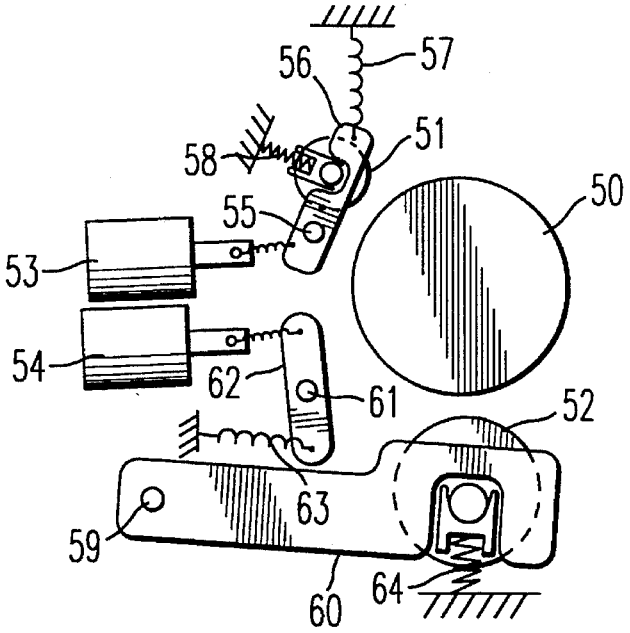
FIG. 20 PRIOR ART
FIG. 20 is a schematic drawing showing a conventional apparatus for driving a charging member and a transfer member.
Figure 21:
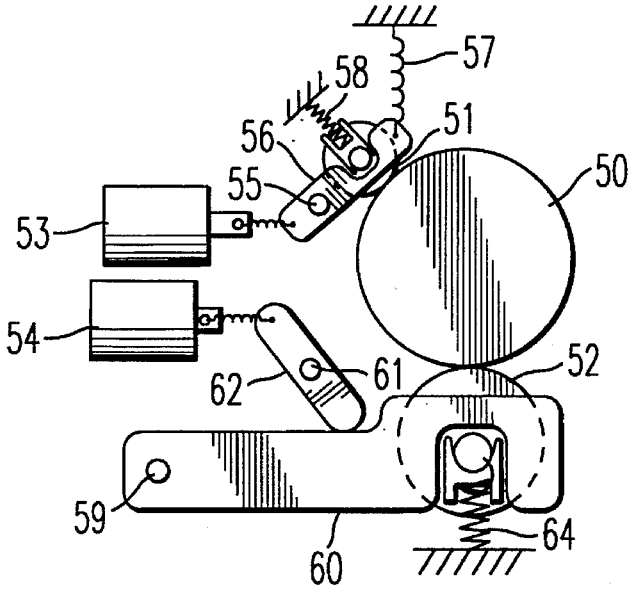
FIG. 21 PRIOR ART
FIG. 21 is a schematic drawing showing another state of the driving apparatus shown in FIG. 20.
Figure 22:
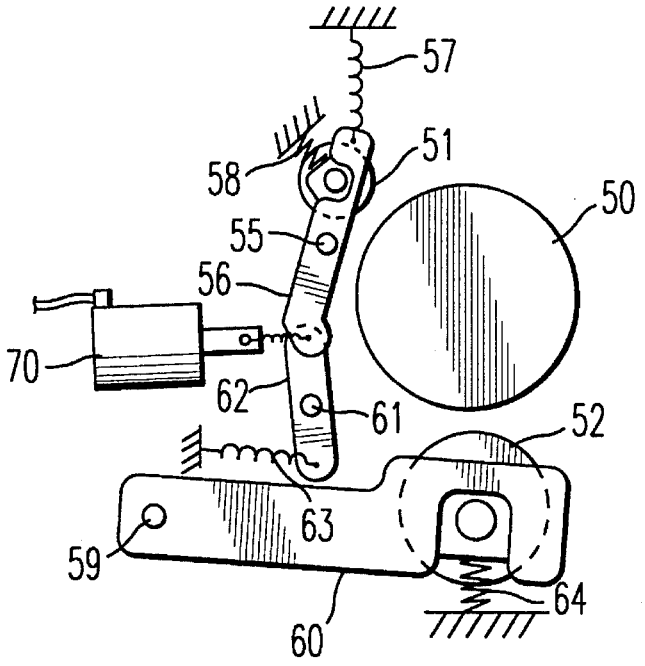
FIG. 22 PRIOR ART
FIG. 22 is a schematic drawing showing another conventional apparatus for driving a charging member and a transfer member.
Figure 23:
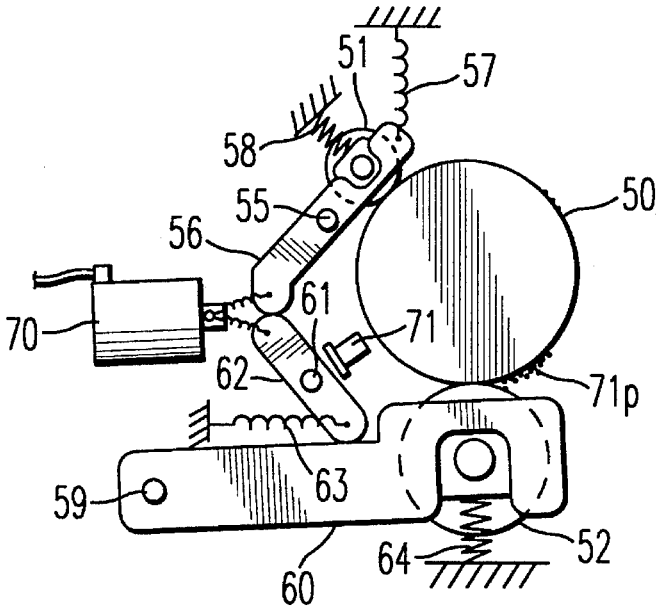
FIG. 23 PRIOR ART
FIG. 23 is a schematic drawing showing another state of the driving apparatus shown in FIG. 22.

Referring now to the drawings, wherein like reference numerals designate identical or corresponding parts throughout the several views, and more particularly to FIG. 19 thereof, various operating components of an image forming apparatus are illustrated. Around a photoreceptor (photoreceptive drum) 1 which rotates in a clockwise direction are provided a charging roller 2 which is a charging member which can be both brought into contact with and separated from the photoreceptor 1, an eraser 3, a developing unit 4, a transfer roller 5 which is a transfer member which can be both brought into contact with and separated from the photoreceptor 1, a cleaning blade 6, a discharging device 7 and so forth. The surface of the photoreceptor 1 is first uniformly charged with the charging member 2 which is in contact with the photoreceptor 1, and then exposed by an optical imaging device equipped with a mirror 8 to form thereupon an electrostatic latent image of an original document. The portion of the electrostatic latent image which does not fit on a paper on which such image is to be eventually transferred are eliminated by the eraser 3 from the surface of the photoreceptor 1, and then a developing toner is applied in the developing unit 4 onto the latent image remaining on the surface of the photoreceptor 1 to form a toner image thereupon.

A sheet of paper on which such toner image is to be transferred is fed in between the photoreceptor 1 and the transfer member 5 from a paper supplying device (not shown in the drawings) to be synchronized by a registering roller 9 with the toner image on the surface of the photoreceptor 1. The toner image on the photoreceptor 1 is then transferred onto the paper fed in-between the photoreceptor 1 and the transfer member 5 due to a bias voltage applied onto the transfer member 5.

The residual toner image on the surface of the photoreceptor 1 which passed through the transfer stage is then cleaned off by the cleaning blade 6 and a residual charge is erased by an optical exposure from the discharging device 7. Also, a pattern image sensor 10 is provided downstream of the transfer member 5 so that the image density of a pattern image 10*p* (FIG. 7), which has been formed passing through the charging member 2 and the developing unit 4, is inspected every time a prescribed number of image forming operations have been performed.

Figure 4:
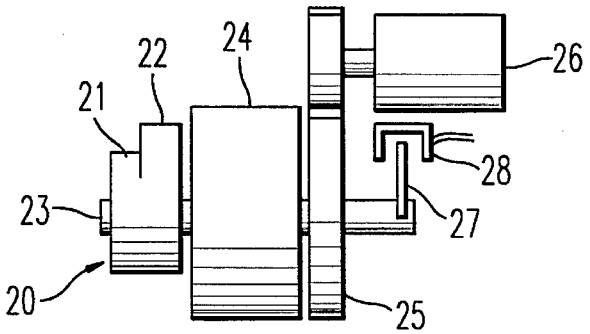
FIG. 4 is a side view showing a driving source and a base state detector for the driving apparatus of the cam illustrated in FIG. 3.
Figure 5:
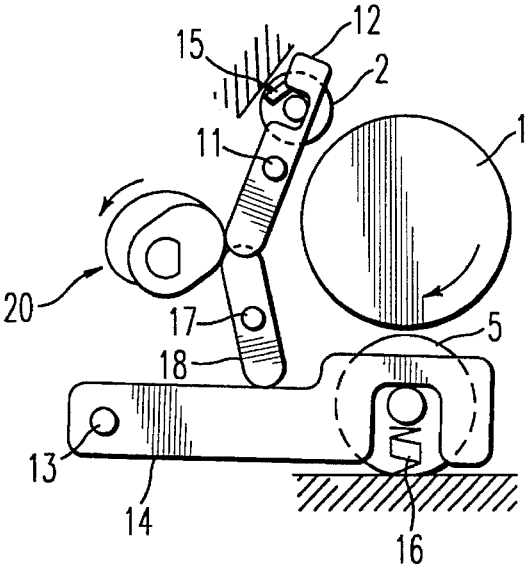
FIG. 5 is a schematic drawing illustrating a state of '0' of a charging roller and a transfer roller of the driving apparatus.
Figure 6:
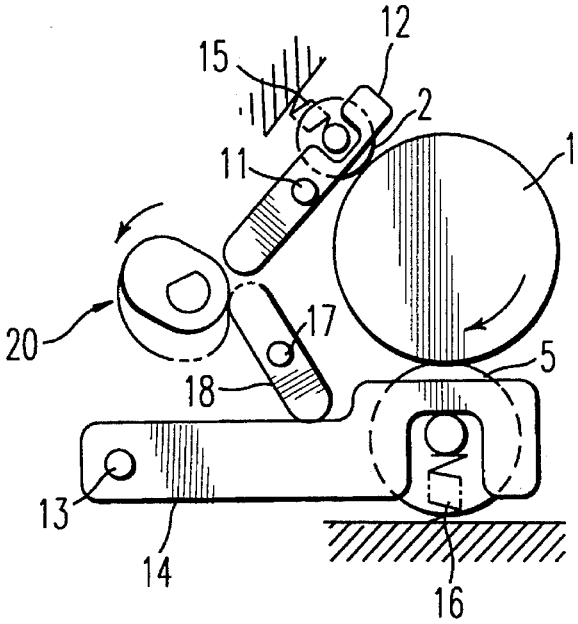
FIG. 6 is a schematic drawing illustrating a state of '1' of the charging roller and the transfer roller of the driving apparatus.
Figure 7:
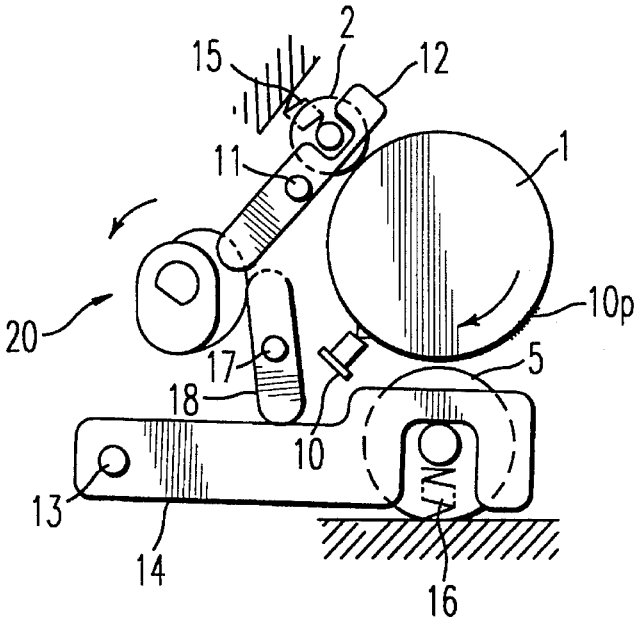
FIG. 7 is a schematic drawing illustrating a state of '2' of the charging roller and the transfer roller of the driving apparatus.

FIG. 3–FIG. 7 illustrate a driving apparatus for the charging member and the transfer member in this embodiment. As shown in FIG. 5–FIG. 7, the charging member 2 is mounted on a top end of a charging member holding arm 12 which is rotatable around a fulcrum 11 and the transfer member 5 is mounted on a top end of a transfer member holding arm 14 which is rotatable around a fulcrum 13, so that the charging member 2 and the transfer member 5 are brought into contact with and separated from the photoreceptor 1. These holding arms 12 and 14 are pushed in the direction to bring respective members mounted thereupon into contact with the photoreceptor 1 by pressuring springs 15 and 16 provided as a means to press such holding arms respectively. The charging member holding arm 12 separates the charging member 2 from the surface of the photoreceptor 1 by its movement in the counter-clockwise direction. At the middle part of the transfer member holding arm 14 is contacted a transfer member driving link 18 which is rotatable around a fulcrum 17. The transfer member holding arm 14 rotates in a clockwise direction with the movement of the transfer member driving link 18 in the clockwise direction, thereby separating the transfer member 5 from the photoreceptor 1. The base ends of the charging member holding arm 12 and the transfer member driving link 18 are both in contact with a cam member 20 shown in FIG. 3.

The cam member 20 is provided with a first cam (the first cam means) 21 and a second cam (the second cam means) 22 on the same axis. The base end of the charging member holding arm 12 is in contact with the first cam 21 and the base end of the transfer member driving link 18 is in contact with the second cam 22. The first cam 21 is provided with a limited area P which places the charging member holding arm 12 in a state rotated in the counter-clockwise direction separating the charging member 15 from the photoreceptor 1 as shown in FIG. 5. The area other than charging member separating area P forms the charging member contacting area to place the charging member holding arm 12 in a state rotated in the clockwise direction bringing the charging member 15 into contact with the photoreceptor 1 as shown in FIG. 6 and FIG. 7.

The second cam 22 is provided with a wide area Q which places the transfer member driving link 18 in a state rotated in the clockwise direction which separates the transfer member 5 from the photoreceptor 1 as shown in FIG. 5 and FIG. 7. The area other than the transfer member separating area Q forms a transfer member contacting area which places the transfer member driving link 18 in a state rotated in the counter-clockwise direction bringing the transfer member 5 into contact with the photoreceptor 1 as shown in FIG. 6.

The charging member separating area P and the charging member contacting area of the first cam 21, and the transfer member separating area Q and the transfer member contacting area of the second cam 22 are made so that when the cam member 20 is divided into three equal parts, 1) the first dividing point **20*a* is located in the area of charging member separating area P of the first cam 21 and in the area of transfer member separating area Q of the second cam 22, 2) the second dividing point 20*b* is located in the area of charging member contacting area of the first cam 21 and in the area of transfer member separating area Q of the second cam 22, and 3) the third dividing point 20*c* is located in the area of charging member contacting area of the first cam 21 and in the area of the transfer member contacting area of the second cam 22**.

As shown in FIG. 4 illustrating the construction of the driving source, the axis 23 of the cam member 20 is connected to a driving clutch 24. The driving clutch 24 has a three positions clutch to stop at three prescribed positions in consecutive order and is connected to a single driving motor 26 through a power transfer gear 25. The driving motor 26 rotates at a fixed speed while the power of the image forming apparatus is on and transfers the rotating power to the power input side of the axis of the driving clutch 24. The driving clutch 24 is provided with positions to stop after each ⅓, ⅔ and ⅔ of a revolution respectively, and rotates the cam member by ⅓ or ⅔ of a revolution in accordance with the instructions given when the clutch driving signal is inputted from the control unit of the image forming apparatus, as described later.

The driving clutch 24 is connected to a sensor for detecting the state shown in FIG. 5 where both the charging member 2 and the transfer member 5 are separated from the photoreceptor 1. Hereinafter, this position is called the base state and the sensor functions as a base state detecting sensor or a base state detector. As shown in FIG. 4, a feeler 27 or protrusion is connected to the axis 23 and is rotated with the cam member 20 and sensed by a sensing device 28. Here, the feeler 27 and sensing device 28 are provided in such a way that the feeler 27 stops at the position to be sensed by the sensing device 28 when the cam member 20 is in the state of placing the charging member 2 and the transfer member 5 in the base state as shown in FIG. 5. In place of the sensing mechanism illustrated in FIG. 4, any device which senses the position of the cam member may be used.

Figure 8:
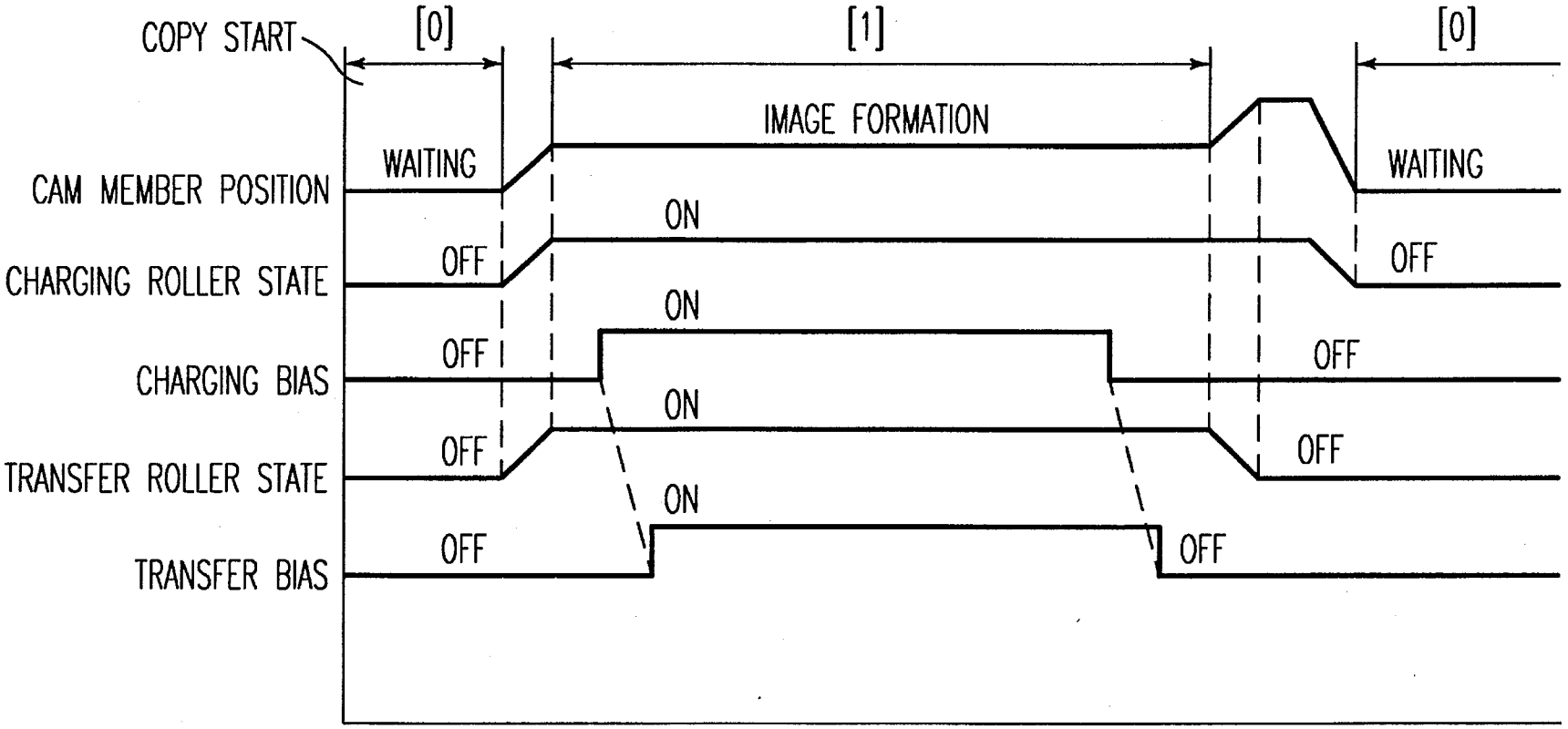
FIG. 8 is a timing chart showing an example of a normal image forming operation.
Figure 9:
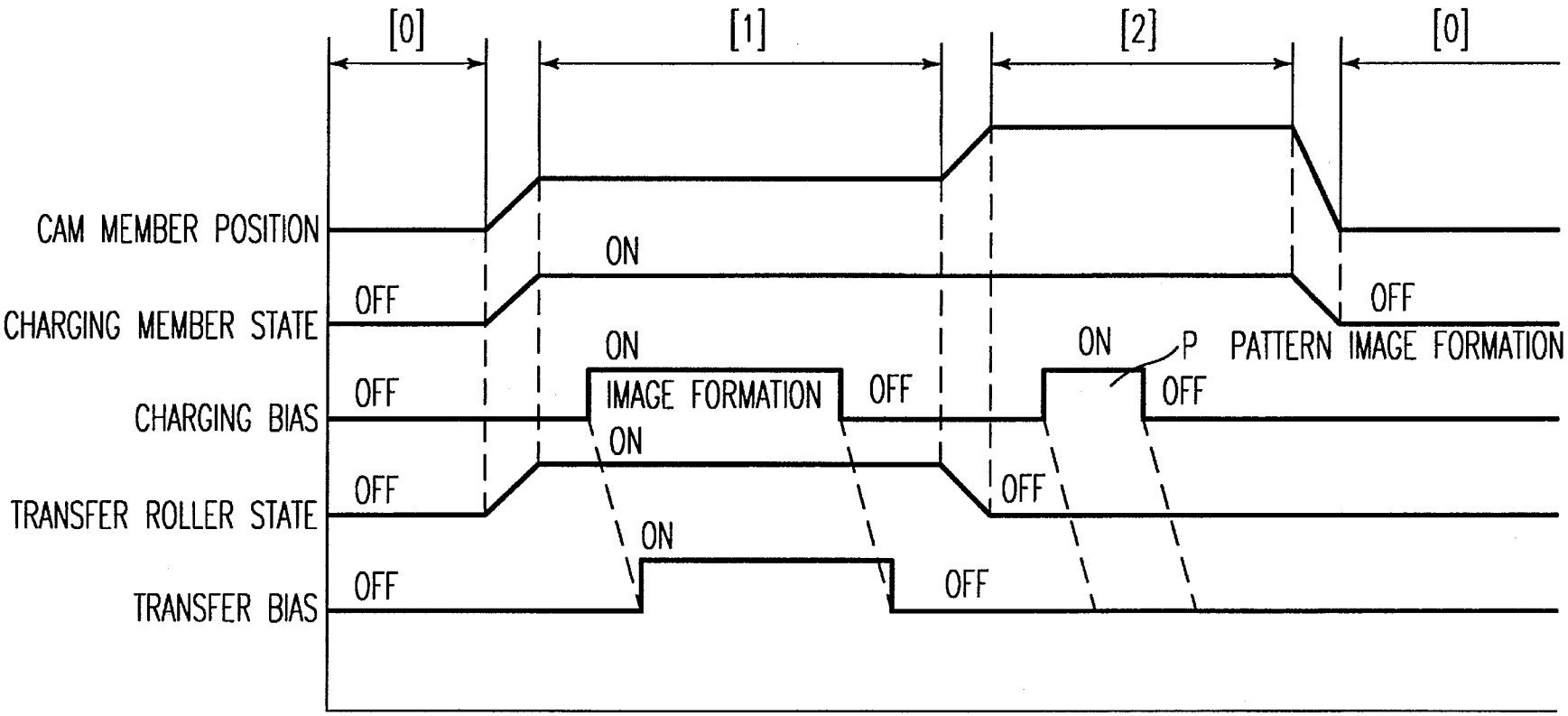
FIG. 9 is a timing chart showing an example of an image density inspecting operation.

FIG. 8 and FIG. 9 are timing charts showing examples of the operations of the driving apparatus described above. FIG. 8 is a timing chart for a normal operation of the image forming apparatus. When the apparatus is in a state of waiting, the cam member 20 is in a position shown in FIG. 5 and the charging member 2 and the transfer member 5 are both separated from the photoreceptor 1 ('0' state). When an image forming operation is started by a depression of an image forming operation start key (hereinafter called simply a start key), the cam member 20 rotates by ⅓ of a revolution to be in a position shown in FIG. 6 and the charging member 2 and the transfer member 5 are both moved into contact with the photoreceptor 1 ('1' state). While the charging member 2 and the transfer member 5 are in this state, a charging bias is applied to the charging member 2 to charge the surface of the photoreceptor 1 and, after a certain or predetermined period of time, a transfer bias is applied to the transfer member 5 to transfer the toner image on the photoreceptor 1 onto a transfer paper. After the completion of the image forming operation, the cam member rotates by ⅔ of a revolution to return, after taking the position shown in FIG. 7, to the position shown in FIG. 5. At this time, both the charging member 2 and the transfer member 5 are separated from the photoreceptor 1 ('0' state).

FIG. 9 is a timing chart showing an operation of performing an image density inspection by the pattern image sensor 10 following an image forming operation. In this timing chart, the cam member 20, after the state of waiting ('0' state) and image forming operation ('1' state), rotates by ⅓ of the revolution to stop at the position shown in FIG. 7 where the charging member 2 is in contact with and the transfer member 5 is separated from the photoreceptor 1 ('2' state). A charging bias is applied to the charging member 2 in this state to form a pattern image **10*p* (illustrated in FIG. 7) on the surface of the photoreceptor 1 and the image density of this pattern image 10*p* is inspected by the pattern image photosensor 10. The transfer member 5 is separated from the photoreceptor 1 during this inspection operation and therefore there exists no possibility of damaging the pattern image 10*p***.

Figure 10:
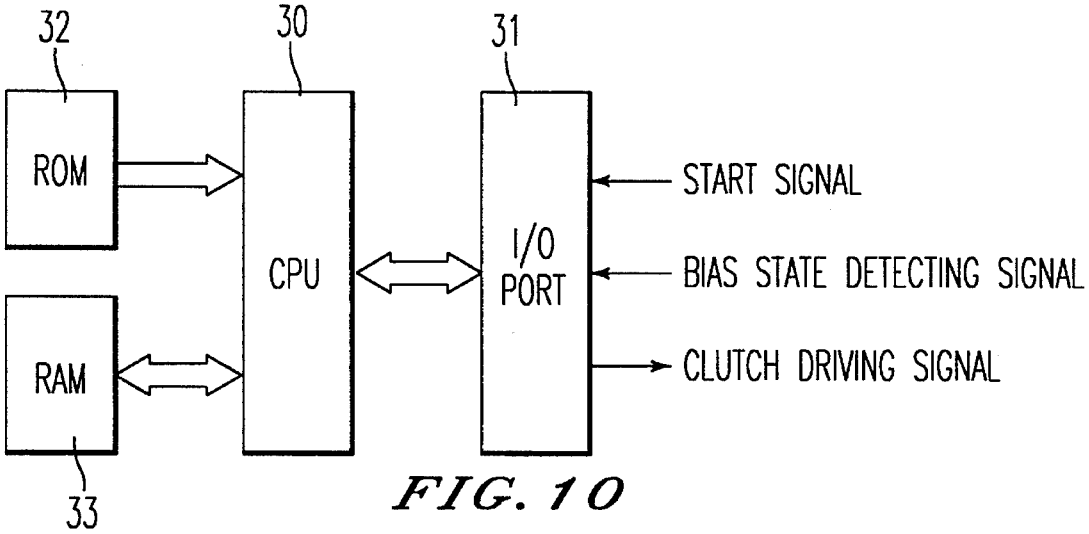
FIG. 10 is a block diagram of a control system in accordance with the present invention.

FIG. 10 is a block diagram of a control system for controlling the driving apparatus described above. The control system according to the present invention is equipped with a control unit (CPU) 30 which may be a general purpose microprocessor or special purpose circuitry, an input and output port (I/O port) 31, ROM 32 and RAM 33. The input and output port 31 receives signals such as a start signal which is sent from the start key of the image forming apparatus and a base state detecting signal which is sent from the base state detecting sensor, and sends these signals to the control unit 30 and at the same time sends a clutch driving signal which is outputted from the control unit 30 to the driving clutch 24. In the ROM 32 are stored a control program and so forth which operate the control unit 30. In RAM 33 is provided a buffer area for storing such information as the current state of the charging member 2 and the transfer member 5 in relation to the photoreceptor 1 (hereinafter called as 'current charging state' and 'current transfer state'), the the state of the charging member 2 and the transfer member 5 after driven in relation to the photoreceptor 1 (hereinafter called a 'destination charging state' and 'destination transfer state') and so forth.

Figure 11:
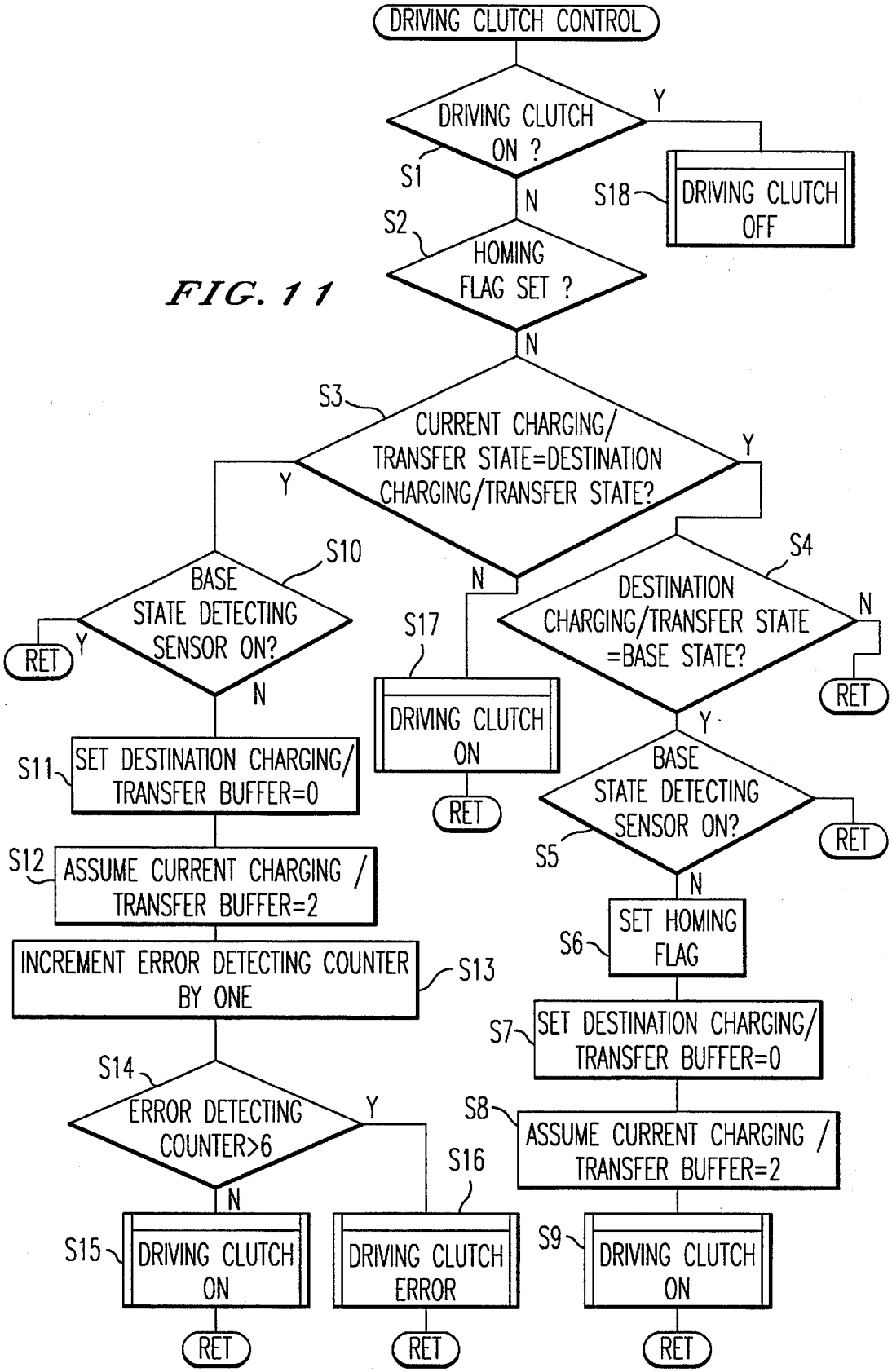
Figure 12:
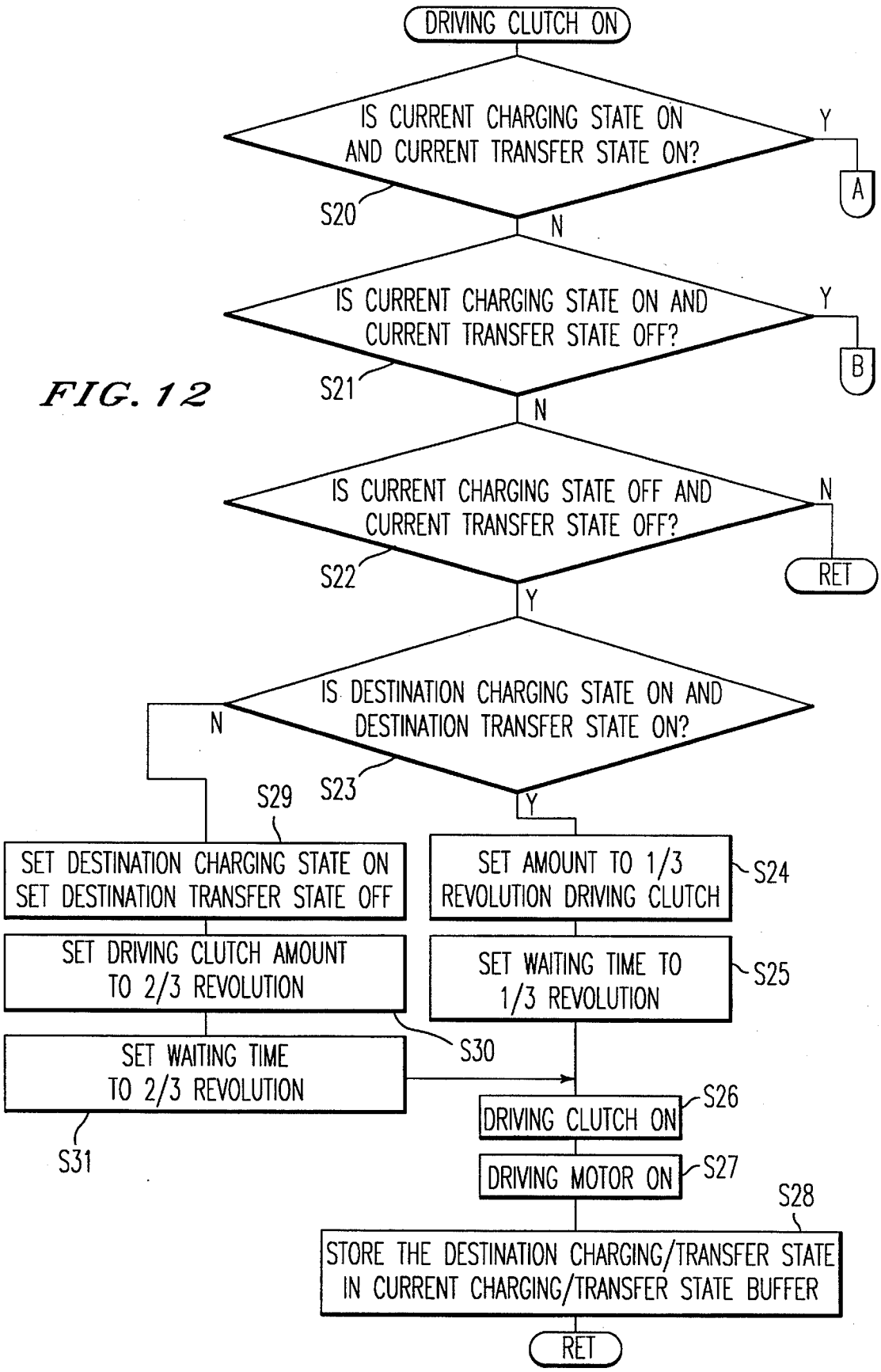
FIGS. 12, 13 and 14 are flowcharts illustrating a control operation of a driving clutch 24 by the control system.
Figure 14:
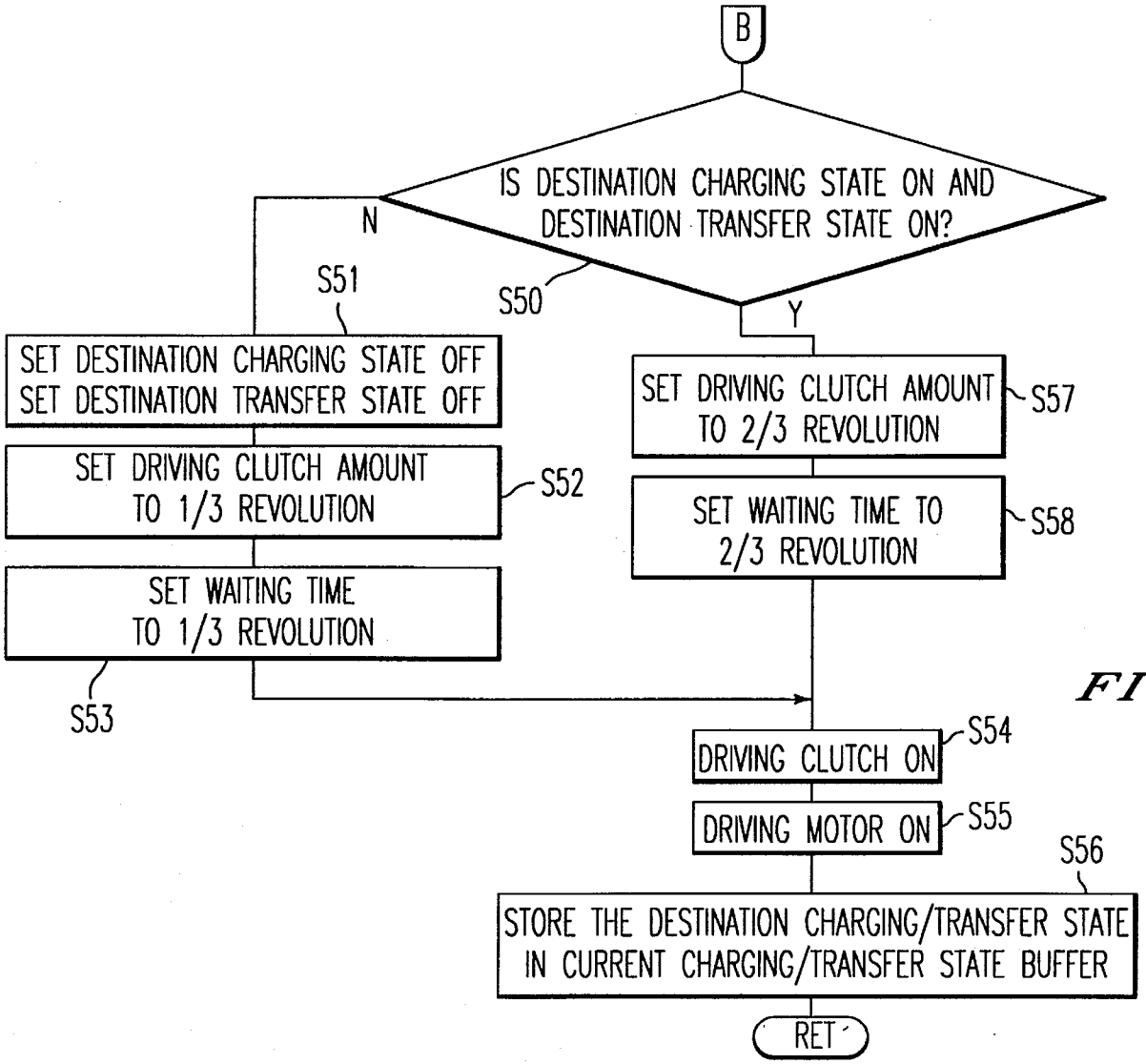

Next, a homing operation of the control system performed when the power is turned on is explained referring to FIG. 11, FIG. 12 and FIG. 14. When the power is turned on, there exists no information as to the position of the driving clutch 24 stored in the buffer area in the RAM 33. Therefore, a homing operation for bringing the charging member 2 and the transfer member 5 to the base state is performed. The control unit 30 first confirms if the driving clutch 24 is on or off as shown in FIG. 11 (step S1). Since the driving clutch 24 is off when the power is turned on, whether or not the driving clutch 24 is in a homing position is determined by examining a homing flag (step S2). Since the homing flag is not set at this moment, whether or not the current charging state and the current transfer state (hereinafter referred to as a current charging and transfer state) are identical with the destination (desired) charging state and the destination (desired) transfer state (hereinafter referred to as a destination charging and transfer state) is determined (step S3). Since the current charging and transfer buffer for storing the current charging and transfer state and the destination charging and transfer buffer for storing the destination charging and transfer state are both set to the base state when the power is turned on as a result of an initial processing, it is confirmed as identical (yes) in step S3 and further in step S4 confirmed that the destination charging and transfer state are in the base state (yes).

Here, it is briefly explained how the current charging and transfer state and the destination charging and transfer state are recognized and recorded. Namely, the state where the charging member 2 and the transfer member 5 are both separated from the photoreceptor 1 as shown in FIG. 5 (base state) is represented as '0', the state where the charging member 2 and the transfer member 5 are both in contact with the photoreceptor 1 as shown in FIG. 6 as '1', and the state where the charging member 2 is in contact with and the transfer member 5 is separated from the photoreceptor 1 as shown in FIG. 7 as '2', and such data representing each state are stored in each buffer areas in the RAM 33. Each of this data representing each state is switched in the order of '0' to '1' to '2' to '0' every time the driving clutch 24 is rotated by ⅓ of a revolution.

Next, whether or not the current charging and transfer state is at the base state '0' is detected by the base state detecting sensor (step S5), and the operation returns to a main routine of the image forming apparatus when the current charging and transfer state is found at the base state '0' since a homing operation is not necessary. On the other hand, when the current charging and transfer state is not at the base state of '0', a homing flag for enabling the driving clutch 24 to perform a homing operation is set (step S6) and '0' is set in the destination charging and transfer buffer (step S7). At this time, the position of the cam member is not known and consequently the exact amount of rotation which is necessary to bring the cam member to the base state is not known. To solve this problem it is assumed that the cam member is at a predefined position. The cam member is rotated by an amount which is necessary to move the cam member from this assumed predefined position to the base state. Then the base state detecting sensor is examined to see if the cam member has actually moved to the base state position. In this example, it is assumed that the current charging and transfer state is '2' and the corresponding data is stored in the current charging and transfer buffer (step S8).

Next, moving to a sub-routine for controlling the operations of the driving clutch 24 shown in FIG. 12, first, whether or not the current charging state and the current transfer state are both in contact with the photoreceptor 1 is confirmed (step S20). The state where the member is in contact with the photoreceptor 1 is hereinafter called 'ON' and the state where the member is separated from the photoreceptor 1 is called 'OFF'. Since the current charging and transfer state has been presumed as '2' in step S8, step S20 determines that only the current charging state is ON. Next, step S21 determines that the current charging state is ON and the current transfer state is OFF and flow proceeds to sub-routine B shown in FIG. 14.

In the sub-routine B shown in FIG. 14, first, whether or not the destination charging state and the destination transfer state are both ON is confirmed (step S50). Since '0' has been stored in the destination charging and transfer buffer in step S7, the destination charging state and the destination transfer state are both OFF in this case and such state is recognized by the controller. Step S51 next sets the destination charging state to OFF and the destination transfer state to OFF. Then in step S52, the rotating amount of the driving clutch 24 is set at ⅓ of a revolution since the state of '2' of the current charging and the transfer state can be switched to the state of '0' by rotating the driving clutch 24 by ⅓ of a revolution. Also, a waiting time for restricting another signal from driving the clutch to come out while the driving clutch is rotating by ⅓ of a revolution is set in step S53. The driving clutch 24 is then operated in step S54 and the driving motor is activated in step S55. The destination charging and transfer state of '0' which has been set in step S7 is stored in the current charging and transfer state buffer (step S56).

The control of the driving system up to this point has been operated assuming the current charging and transfer state has been set to the state of '2' in step S8. However, it is not certain whether the charging member 2 and the transfer member 5 have been actually brought into the destination charging and transfer state. Therefore, the operation returns to the sub-routine shown in FIG. 11 and continues the homing operation. Namely, whether the driving clutch 24 is in operation or not is confirmed in step S1 and the operation proceeds to step S2 if the driving clutch is not in operation. In case the waiting time which has been set in step S53 of FIG. 14 has not been passed yet, the driving clutch 24 is made off, there is a wait for the waiting time to pass, and the process returns to step S1. In case the driving clutch 24 is not in operation and the waiting time has been passed, the operation proceeds to step S2. Since the homing flag has been set by previously performing step S6, the operation proceeds to step S10 to detect by the base state detecting sensor whether the current charging and transfer state is at the base state of '0'. In case the current charging and the transfer state is at the base state of '0', the operation returns to the main routine of the image forming apparatus after resetting the homing flag.

When the current charging and transfer state is not at the base state of '0', the base state of '0' is set in the destination charging and transfer buffer (step S11). In step S12, it is again assumed that the current charging and transfer state is '2' and the corresponding data is stored in the current charging and transfer buffer. Then, an error detecting counter which is provided in the control unit is incremented by one (step S13).

If the error counter is greater than 6 in step S14, or other predetermined value, it is judged that the driving clutch 24 is out of order or not operating correctly in step S16. Namely, the current charging and transfer state should return to the base state while the driving clutch 24 makes one revolution if the driving clutch 24 is in good order. Therefore, in case the base state is not detected during the homing operation after rotating the driving clutch 24 more than one revolution, it can be judged that the driving clutch 24 is out of order. In this embodiment, it is so designed considering a possibility of detecting errors occurs, to judge the driving clutch 24 is out of order in case the error detecting counter counts up more than 6, which is to rotate the driving clutch by 2 revolutions even if the homing operation is repeated at every ⅓ of a revolution. In case the value of the error detecting counter does not exceed 6, the operation proceeds to a sub-routine for controlling the operation of the driving clutch 24 shown in FIG. 12 (step S15). Then, the operation proceeds to steps S20 and S21 of FIG. 12, followed by steps S50–S56 of FIG. 14, and then, returning to a sub-routine of FIG. 11, to steps S1, S2 and S10 of FIG. 11 to detect, by the base detecting sensor, whether or not the current charging and transfer state is at the base state of '0'. In case the current charging and transfer state is in the base state of '0', the operation returns to the main routine of the image forming apparatus after resetting the homing flag. In case the current charging and transfer state is not at the base state of '0', the operation proceeds to the steps after step S11 as described above and the homing operation is repeated within the limitation set by the error detecting counter until the base state is detected.

Figure 15:
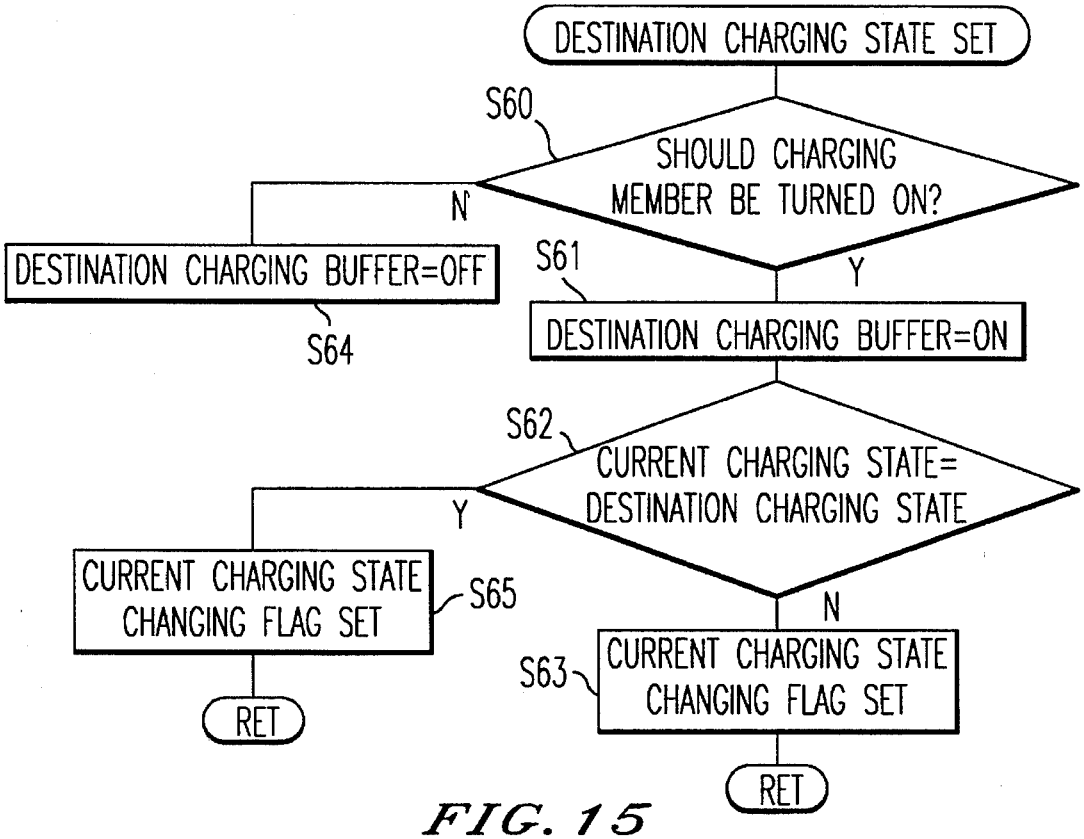
FIG. 15 is a flowchart illustrating an operation of setting a destination charging state by the control system.
Figure 16:
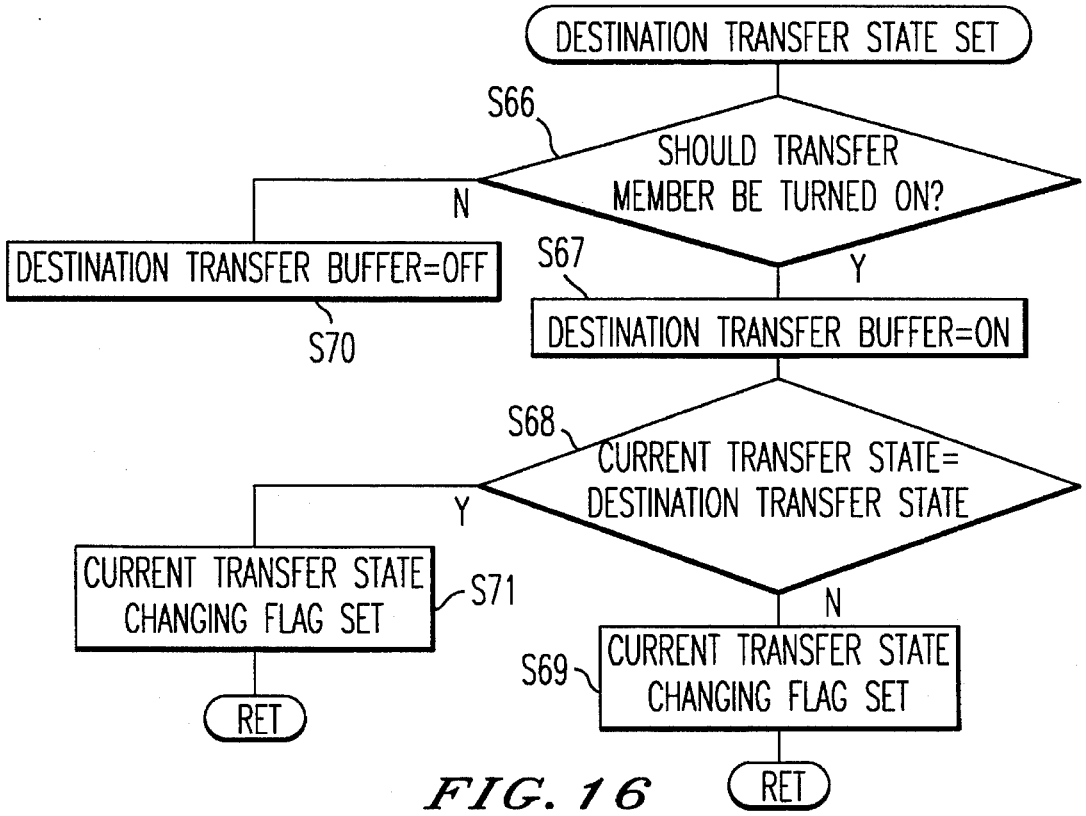
FIG. 16 is a flowchart illustrating an operation of setting a destination transfer state by the control system.
Figure 17A:
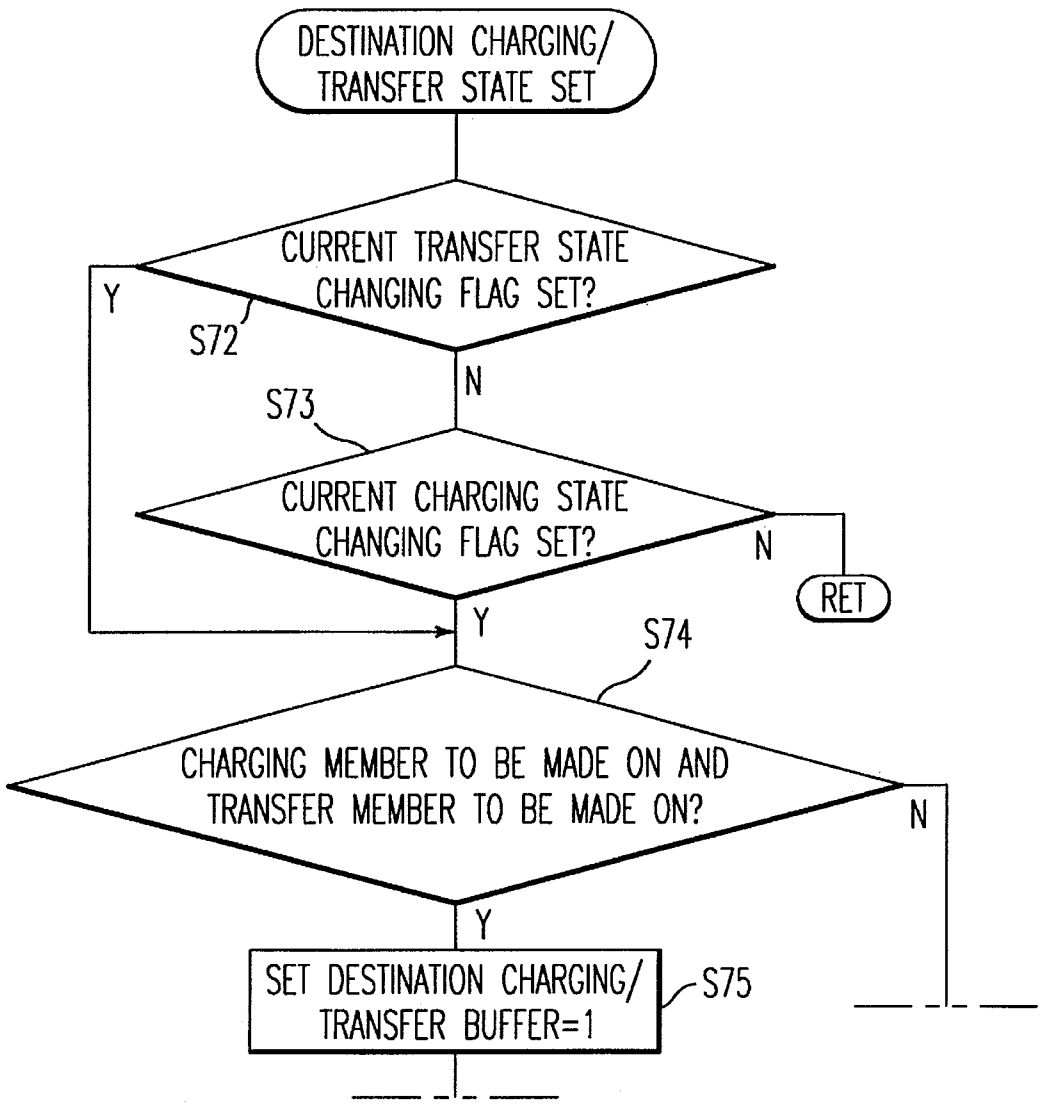
FIG. 17 is a flowchart, following FIG. 15 and FIG. 16, illustrating an operation of setting the destination charging and transfer states.
Figure 17B:
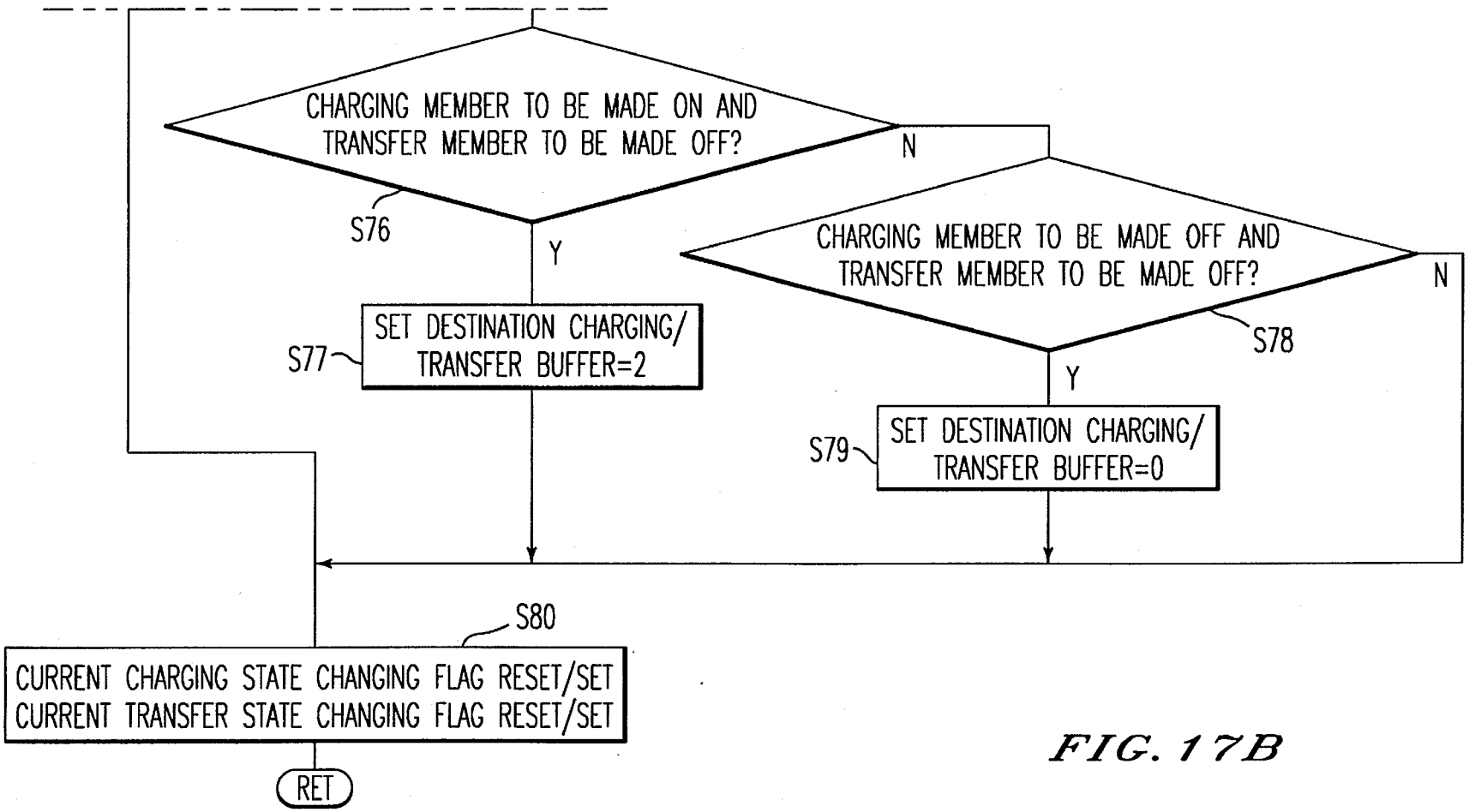

Next, the operation of setting the destination charging and transfer state is explained referring to FIGS. 15–17. As described earlier, after the power of the image forming apparatus is turned on, the charging member 2 and the transfer member 5 are placed at the base state of '0' as shown in FIG. 5 while the apparatus is not in operation, and at the state of '1' as shown in FIG. 6 while the apparatus is performing the operation of image forming. Further, the charging member 2 and the transfer member 5 are placed in the state of '2' as shown in FIG. 7 in case the image density detecting sensor 10 is operated in this embodiment. In order to change the state of the current charging and transfer state as described above, the current charging state changing flag and the current transfer state changing flag are set or reset in accordance with the flowcharts shown in FIG. 15 and FIG. 16.

In FIG. 15, which is used to set the current charging state changing flag, step S60 determines whether the charging member 2 is to be made ON or OFF. The destination charging state is set at ON in step S61 when the charging member 2 is to be made ON and the destination charging state is set to OFF in step S64 when the charging member 2 is to be made OFF. Whether or not the current charging state is identical with the destination charging state which has been set as above is determined in step S62 and if not, a current charging state changing flag is set in step S63, and if yes, the same flag is reset in step S65.

As for changing the current transfer state changing flag, first whether the transfer member is to be made ON or OFF is confirmed (step S66), and the destination transfer state is set ON (step S67) when the transfer member is to be made ON and the destination transfer state is set at OFF when the transfer member is to be made OFF (step S70). Then, whether or not the current transfer state is identical with the destination transfer state which has been set as above is determined (step S68) and if not, a current transfer state changing flag is set (step S69) and if yes, the same flag is reset (step S71).

After each state changing flag has been specified as described above, the operation proceeds to a sub-routine shown in FIG. 17. In this sub-routine, whether or not the current transfer state changing flag and the current charging state changing flag are set or reset is confirmed respectively (steps S72, S73), and the operation returns to the main routine of the image forming apparatus if both flags are reset since changes of the current charging and transfer state are not necessary. In case either flag is set, on the other hand, whether the charging member 2 and the transfer member 5 are to be made ON or OFF is confirmed respectively (steps S74, S76, S78). '1' is stored in the destination charging and transfer buffer in case both members are to be made ON (step S75), and a signal to set or reset the current charging state changing flag and the current transfer state changing flag is outputted (step S80). In case the charging member 2 is to be made ON and the transfer member 5 is to be made OFF, '2' is stored in the destination charging and transfer buffer (step S77) and a signal to set or reset the current transfer state changing flag and the current charging state changing flag is outputted (step S80). Further, in case both members are to be made OFF, '0' is stored in the destination charging and transfer butter (step S79) and a signal to set or reset the current transfer state changing flag and the current charging state changing flag is outputted (step S80).

Next, a control operation of the driving clutch 24 in accordance with the current charging and transfer state changing flags which have been set as described above is explained referring to FIGS. 11–14. After the destination charging and transfer state has been set as described above, the operation proceeds to steps S1, S2, S3 and S17 of the sub-routine shown in FIG. 11 and then moves to the sub-routine shown in FIG. 12. In the sub-routine shown in FIG. 12, first the current charging and transfer state is confirmed (steps S20, S21, S22), and the operation proceeds to sub-routine A shown in FIG. 13 when the current charging and transfer state is at the state of '1'; that is, a state where the charging member 2 and the transfer member 5 are both ON. Alternatively, the operation proceeds to sub-routine B shown in FIG. 14 in case the current charging and transfer state is at the state of '2'; that is a state where only the charging member is ON. Further, the operation proceeds to step S23 and thereafter to FIG. 12 in case the current charging and transfer state is at the state of '0'; that is a state where the charging member 2 and the transfer member 5 are both OFF.

Figure 13:
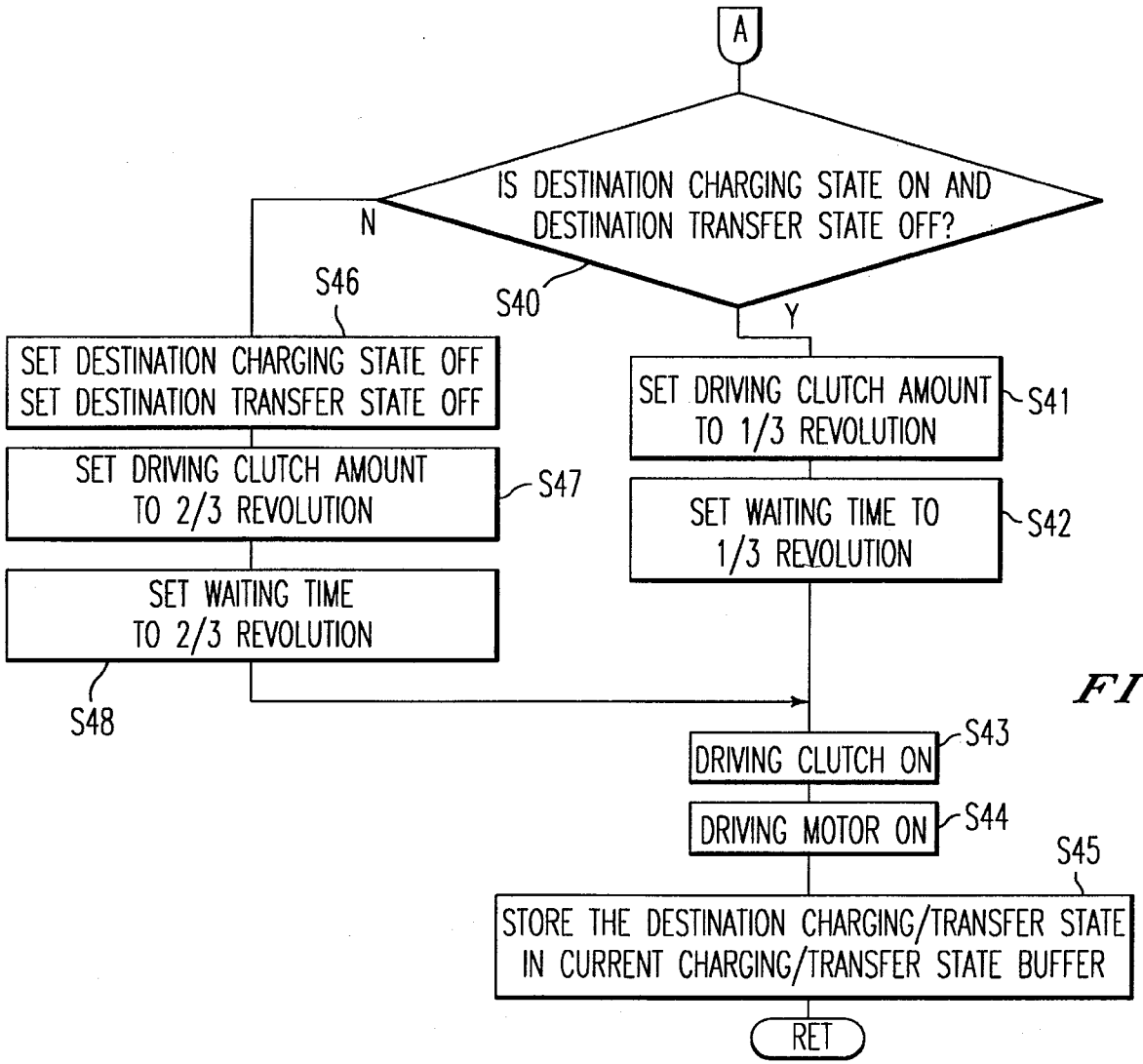

First, the case where the current charging and the transfer state is '1' is explained referring to FIG. 13. The destination charging and transfer state which has been set in steps S75, S77, S79 in FIG. 17 is first confirmed (step S40). When the destination charging and transfer state is at the state of '2'; that is a state where the destination charging state is ON and the destination transfer state is OFF, the rotating amount of the driving clutch 24 is set at ⅓ of the revolution in step S41 since the current charging and transfer state of '1' can be switched to the state of '2' by ⅓ of a revolution of the driving clutch 24. Then, a waiting time for restricting another signal to drive the driving clutch to come out while the driving clutch rotates ⅓ Of the revolution is set (step S42). The driving clutch 24 is then operated (step S43) and the driving motor is activated (step S44). The state of '2' of the destination charging and the transfer state is then stored in the current charging and transfer state buffer (step S45). In case the destination charging and transfer state is not at the state of '2', the destination charging and transfer state is at the state of '0'; that is a state where the destination charging state and the transfer state are both OFF (step S46).

Since the current charging and transfer state of '1' can be switched to the state of '0' by rotating the driving clutch 24 by ⅔ of a revolution, such rotating amount of the driving clutch 24 is set in step S47. Next, a waiting time for restricting another signal to drive the driving clutch to come out while the driving clutch is making ⅔ of the revolution is set (step S48). The driving clutch 24 is then operated (step S43) and the driving motor is activated (step S44). The destination charging and transfer state of '2' is stored in the current charging and transfer state buffer (step S45). When the destination charging and transfer state is at the state of '1'; that is a state where the destination charging state and the destination transfer state are both ON, such destination charging and transfer state has been detected to be identical with the current charging and the transfer state in steps S3 and S4 in FIG. 11, which returns the operation to the main routine of the image forming apparatus.

Next the case where the current charging and transfer state is at the state of '2' is explained referring to FIG. 14. The destination charging and transfer state which has been set in steps S75, S77 and S79 in FIG. 17 is confirmed (step S50) first. In case the destination charging state and the destination transfer state is at the state of '0'; that is a state where the destination charging state and the destination transfer state are both OFF (step S51), the rotating amount of the driving clutch 24 is set to ⅓ of a revolution in step S52. Next, a waiting time for restricting another signal to drive the driving clutch while the driving clutch rotates ⅓ of a revolution is set (step S53). Then, the driving clutch 24 is operated (step S54) and the driving motor is activated (step S55). The destination charging and transfer state of '0' is stored in the current charging and transfer state buffer (step S56).

In case the destination charging and transfer state is not at the state of '0', the destination charging and the transfer state is at the state of '1' where both the charging member and the transfer member are ON. Since the current charging and transfer state of '2' can be switched to the state of '1' by rotating the driving clutch 24 by ⅔ of a revolution, such rotating amount of the driving clutch 24 is set in step S57. Next, a waiting time for restricting another signal to drive the driving clutch 24 while the driving clutch 24 is making ⅔ of a revolution is set (step S58). The driving clutch 24 is then operated (step S54) and the driving motor is activated (step S55). The destination charging and transfer state of '1' is then stored in the current charging and transfer buffer (step S56). When the destination charging and transfer state is at the state of '2'; that is a state where the destination charging state is ON and the destination transfer state is OFF, such destination charging and transfer state has been detected as being identical with the current charging and transfer state in steps S3 and S4 in FIG. 11 and the operation has been already returned to the main routine of the image forming apparatus.

Next, the case where the current charging and transfer state is at the state of '0' is explained referring to FIG. 12. The destination charging and transfer state which has been set in steps S75, S77 and S79 in FIG. 17 is confirmed first (step S23). In case the destination charging and transfer state is at the state of '1'; that is a state where the destination charging state and the destination transfer state are both ON, the rotating amount for the driving clutch 24 is set at ⅓ of a revolution in step S24. Next, a waiting time to restrict another signal to drive the driving clutch 24 while the driving clutch 24 is making ⅓ of a revolution is set (step S25). Then, the driving clutch 24 is operated (step S26) and the driving motor is activated (step S27). The destination charging and transfer state of '1' is then stored in the current charging and transfer state buffer (step S28). When the destination charging and transfer state is not the state of '1', the destination charging and transfer state is at the state of '2'; that is a state where only the destination charging state is ON and the destination transfer state is OFF (step S29). Therefore, the rotating amount for the driving clutch 24 is set at ⅔ of a revolution in step S30. Next, a waiting time to restrict another signal to drive the driving clutch 24 while the driving clutch 24 is making ⅔ of the revolution is set (step S31). Then the driving clutch is operated (step S26) and the driving motor is activated (step S27). The destination charging and transfer state of '2' is stored in the current charging and transfer state buffer (step S28). In case the destination charging and transfer state is at the state of '0'; that is the destination charging state and the destination transfer state are both OFF, such destination charging and transfer state has been detected to be identical with the current charging and transfer state in steps S3, S4 and S5 in FIG. 11 and the operation has been already returned to the main routine of the image forming apparatus.

Figure 18:
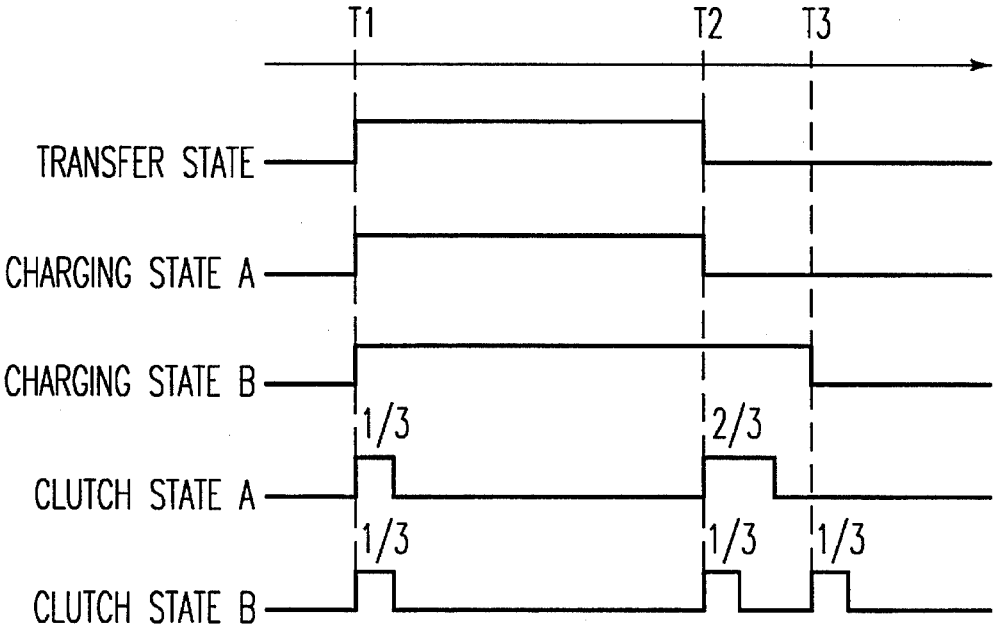
FIG. 18 is a timing chart illustrating a timing sequence of a charging member 2 and a transfer member 5 contacting with and separating from a photoreceptor 1 and also a timing sequence of a driving clutch 24 being operated.

FIG. 18 is a timing chart illustrating a timing sequence of the charging member 2 and the transfer member 5 contacting with and separating from the photoreceptor 1 and also a timing sequence of the driving clutch 24 being operated. Charging state A is a timing sequence of the charging member 2 contacting with and separating from the photoreceptor 1 in a normal image forming operation and it is a timing of the current charging and transfer state being changed from '0' to '1' and back to '0' again when the image forming operation is completed. As 'Clutch State A' illustrates, the driving clutch 24 is operated when the image forming operation is started with the depression of the start key (T1), and in operation while the driving clutch 24 is making ⅓ of the revolution after following the steps described above. The driving clutch 24 is operated again for ⅔ of a revolution when the image forming operation is completed (T2). The charging member 2 and the transfer member 5 return to the state as shown in FIG. 5 after the driving clutch 24 completes the ⅔ revolution.

'Charging State B' illustrates a timing sequence of the charging member 2 contacting with and separating from the photoreceptor 1 in the case where the image density inspection by the image density sensor 10 is performed following the image forming operation, and it is a timing of the current charging and transfer state being changed from '0' to '1' and further from '1' to '2' when the image forming operation is completed and subsequently changed to '0' when the image density inspection is completed. In this case, as 'Clutch State B' illustrates, the driving clutch 24 is activated when the image forming operation is started with the depression of the start key (T1) and is in operation while the driving clutch 24 is making ⅓ of a revolution following the control steps described above. The driving clutch 24 is further activated when the operation moves from the image forming operation to the image density inspection operation (T2) and in operation while the driving clutch 24 is making ⅓ of a revolution after following the control steps described above. The driving clutch 24 is operated again when the image density inspection operation is completed (T3) and is in operation while the driving clutch 24 is making ⅓ of a revolution. The charging member 2 and the transfer member 5 return to the state shown in FIG. 5 when the driving clutch complete such ⅓ of a revolution.

The control system of the invention may be conveniently implemented using a general purpose digital computer or microprocessor programmed according to the teachings of the present invention, as would become apparent to those skilled in the art and is preferably implemented using the structure illustrated in FIG. 18. Appropriate software coding used by the control system can readily be prepared by skilled programmers based on the teaching of the present disclosure, as will be apparent to those skilled in the software art. The invention may also be implemented by the preparation of application specific integrated circuits or by interconnecting an appropriate network of conventional component circuits, as will be readily apparent to those skilled in the art.

Figure 1:
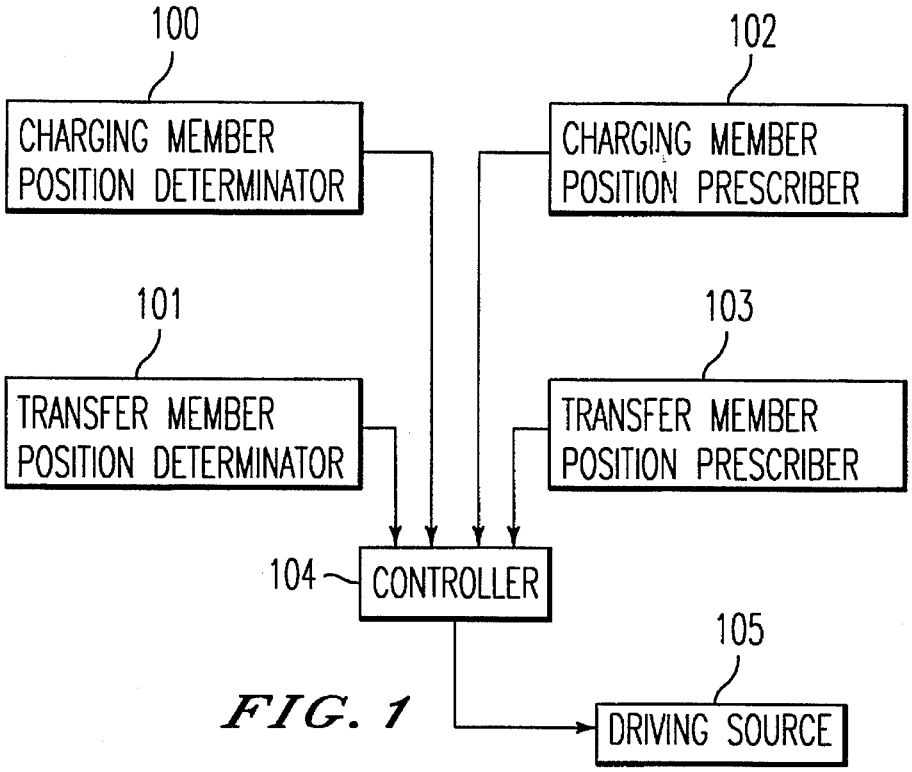
FIG. 1 is a functional block diagram of a control system in accordance with an embodiment of the invention.
Figure 2:
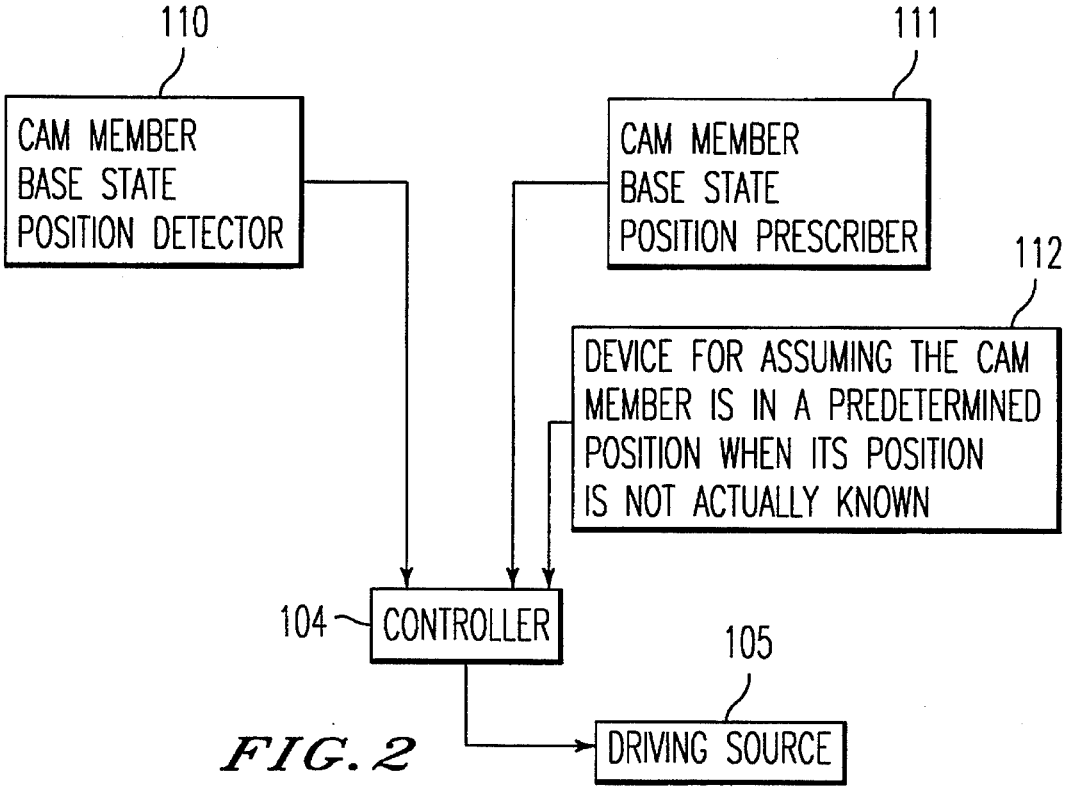
FIG. 2 is a functional block diagram of a control system in accordance with another embodiment of the invention.
Figure 3:
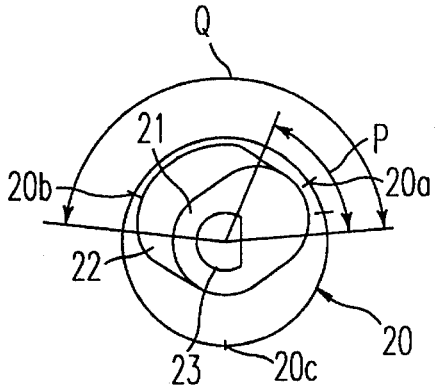
FIG. 3 is a plan view showing a cam of a driving apparatus of the present invention.

While the present invention is preferably implemented using a processor, FIGS. 1 and 2 illustrate a functional block diagram of the control system which operates in accordance with the above description of the functions of the invention. The control system of the invention, as shown in FIG. 1, includes a charging member position determinator 100 which is used to determine and keep track of the current position of the charging member. Similarly, there is a transfer member position determinator 101 which is used to determine and keep track of the current position of the transfer member. There is a charging member positioned prescriber 102 and a transfer member position prescriber 103 which prescribe or dictate the future positions of the charging member and the transfer member, respectively in accordance with the illustrated flowcharts. A controller 104 receives the outputs from the elements 100–103 to determine an amount to move the single driving source of the invention and outputs a signal to the single driving source 105.

In order for the invention to properly operate, it is necessary to know the position of the cam member when the image forming device is initially powered on. One manner of determining the position is to assume that the cam member is in a predetermined position, even though the position is not actually known at the time the image forming device is started up. A cam member base state position detector 110 which corresponds to the sensor 28 illustrated in FIG. 4 is used to determine if the cam member is in the base state position. If it is not, element 112 of FIG. 2 is used which is a device for assuming the cam member is in a predetermined position when its position is not actually known. In the preferred embodiment, the cam member should always be in one of three positions. Therefore, if it is not in the base position, as detected by the detector 110, it should be in one of the other positions. Element 112 simply assumes that it is in a predetermined position and the controller 104 is used to rotate the driving source 105 one third of a revolution. Thereafter, the cam member base state position detector 110 is used to see if the cam has moved into the base state. If it has not, the device for assuming the cam member is in a predetermined position when its position is not actually known is again activated and again the cam member is assumed to be in the predetermined position. The cam member is then rotated one third of a revolution which should bring the cam member to the base state because each of the three possible positions of the cam member will have been tested. The cam member base state position prescriber 111 performs the above-described operation of moving the cam-member to the base state. This process is the process described in the flowchart of FIG. 11 and the flowcharts which are called by FIG. 11. Additionally, the elements of FIG. 1 may be used in conjunction with the elements of FIG. 2, after FIG. 2 moves the cam member to the base state.

While the presently preferred embodiment of the present invention has been shown and described above, it is to be understood that this disclosure is for the purpose of illustration and that various changes and modifications may be made without departing from the scope of the invention as set forth herein.

The charging member may be a charging blade, charging roller, or other suitable charging devices. Also, the transfer member may be a transfer roller, a transfer belt or other suitable transfer device.

It is possible with the present invention to place the charging member 2 and the transfer member 5 in any of a state where the charging member 2 and the transfer member 5 are both in contact with the photoreceptor 1, a state where both members are separated from the photoreceptor 1 and a state where only the transfer member 5 is in contact with the photoreceptor 1. Further, it is possible to place the charging member 2 and the transfer member 5 in any of a state where the charging member 2 and the transfer member 5 are both in contact with the photoreceptor 1, a state where both members are separated from the photoreceptor 1, a state where only the charging member 2 is in contact with the photoreceptor 1 and a state where only the transfer member 5 is in contact with the photoreceptor 1. Additionally, the cam member (cam means) 20 may be formed accordingly so that the charging member and the transfer member are placed in such state as described above.

Figure 24:
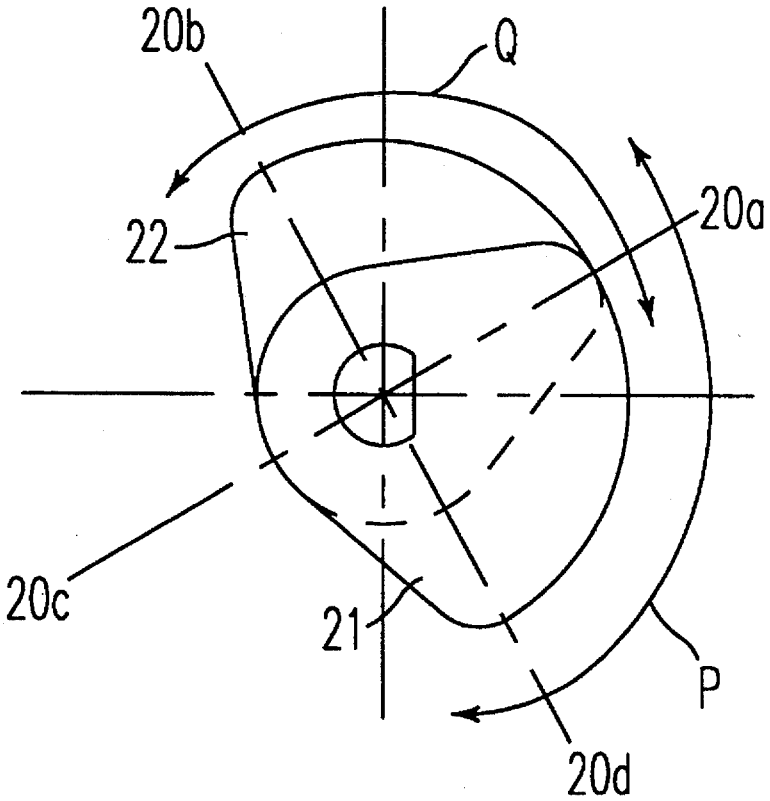
FIG. 24 is a plan view showing another example of a cam member of the present invention.

FIG. 24 illustrates an example of a cam member with four stopping positions realizing the various states described above as well as the states described in the first embodiment. In FIG. 24, the charging member separate area P, the charging member contacting area of the first cam 21, the transfer member separating area Q, and the transfer member contacting area of the second cam 22 are made so that when the cam member 20 is divided into four equal parts, 1) the first dividing point **20*a* is located in the area of charging member separating area P of the first cam 21 and in the area of transfer member separating area Q of the second cam 22, 2) the second dividing point 20*b* is located in the charging member contacting area of the first cam 21 and the transfer member separating area Q of the second cam 22, 3) third dividing point 20*c* is located in the area of charging member contacting area of the first cam 21 and the transfer member contacting area of the second cam 22, and 4) fourth dividing point 20*d* is located in the area of charging member separating area P of the first cam 21 and the transfer member contacting area of the second cam 22**.

As described above, with the driving apparatus in accordance with this invention, it is possible to realize, in a simple and a compact mechanism, an individual driving of a charging member and a transfer member of an image forming apparatus in both directions of contacting with and separating from a photoreceptor so that the charging member and the transfer member can be placed in various states in relation to the photoreceptor as such image forming apparatus demands.

Further, with the control system for such driving apparatus according to the present invention, it is possible to realize, in a simple control program for such driving apparatus, a control of such various state of the charging member and the transfer member in relation to the photoreceptor as the image forming apparatus demands.

What is claimed as new and desired to be secured by Letters Patent of the United States is:

1. An image forming system, comprising:

a photoreceptor;

a charging member which charges the photoreceptor;

a transfer member which transfers images from the photoreceptor;

a single driving source which drives the charging member and the transfer member both towards and away from the photoreceptor to positions including:

1) both the charging member and the transfer member being in contact with the photoreceptor, 2) both the charging member and the transfer member being separated from the photoreceptor, and 3) one of the charging member and the transfer member being in contact with the photoreceptor while the other of the charging member and the transfer member is separated from the photoreceptor.

2. An image forming system according to claim 1, wherein said single driving source includes:

a first cam having an axis of rotation; and a second cam having a same axis of rotation as the axis of rotation of the first cam, said image forming system further including:

a first connector contacting a surface of the first cam which moves the charging member depending on a rotational position of the first cam; and a second connector contacting a surface of the second cam which moves the charging member depending on a rotational position of the second cam.

3. An image forming system according to claim 2, wherein:

said first cam and said second cam are integrally formed as a single unit.

4. An image forming system according to claim 2, further comprising a control system which includes:

means for recognizing a current position of said charging member in relation to said photoreceptor;

means for recognizing a current position of said transfer member in relation to said photoreceptor;

means for prescribing a future position of said charging member in relation to said photoreceptor;

means for prescribing a future position of said transfer member in relation to said photoreceptor; and control means for driving said single driving source until said charging member and said transfer member move from their respective current positions to their respective future positions.

5. An image forming system according to claim 4, wherein said means for recognizing the current position of the charging member and the means for recognizing the current position of the transfer member each operate by keeping track of an amount of movement of the driving source, after a base state position of the driving source has been determined.

6. An image forming system according to claim 2, further comprising a control system which includes:

means for detecting if said charging member and said transfer member are at a base state;

means for assuming current positions of said charging member and said transfer member are at a base state, when said means for detecting if said charging member and said transfer member detects that said charging member and said transfer member are not at the base state; and control means for operating said driving source a predetermined amount and when said charging member and said transfer member do not reach said base state, again operating said driving source said predetermined amount until the base state has been determined by said means for detecting.

7. An image forming system according to claim 1, further comprising a control system which includes:

means for recognizing a current position of said charging member in relation to said photoreceptor;

means for recognizing a current position of said transfer member in relation to said photoreceptor;

means for prescribing a future position of said charging member in relation to said photoreceptor;

means for prescribing a future position of said transfer member in relation to said photoreceptor; and control means for driving said single driving source until said charging member and said transfer member move from their respective current positions to their respective future positions.

8. An image forming system according to claim 7, wherein said means for recognizing the current position of the charging member and the means for recognizing the current position of the transfer member each operate by keeping track of an amount of movement of the driving source, after a base state position of the driving source has been determined.

9. An image forming system according to claim 1, further comprising a control system which includes:

means for detecting if said charging member and said transfer member are at a base state;

means for assuming current positions of said charging member and said transfer member are at a base state, when said means for detecting if said charging member and said transfer member detects that said charging member and said transfer member are not at the base state; and control means for operating said driving source a predetermined amount and when said charging member and said transfer member do not reach said base state, again operating said driving source said predetermined amount until the base state has been determined by said means for detecting.

* * * * *